US007703762B2

(12) United States Patent
Hattori

(10) Patent No.: US 7,703,762 B2
(45) Date of Patent: Apr. 27, 2010

(54) SHEET SUPPLY DEVICE AND IMAGE FORMING APPARATUS

(75) Inventor: Makoto Hattori, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 12/292,443

(22) Filed: Nov. 19, 2008

(65) Prior Publication Data

US 2009/0079126 A1 Mar. 26, 2009

Related U.S. Application Data

(62) Division of application No. 11/288,192, filed on Nov. 29, 2005, now Pat. No. 7,513,496.

(30) Foreign Application Priority Data

Nov. 30, 2004 (JP) ..... 2004-347642

(51) Int. Cl.
*B65H 3/06* (2006.01)

(52) U.S. Cl. ..... 271/117; 271/110; 271/157

(58) Field of Classification Search ..... 271/117, 271/157, 110

See application file for complete search history.

(56) References Cited

U.S. PATENT DOCUMENTS

| | | | |
|---|---|---|---|
| 5,501,444 | A | 3/1996 | Yukimachi et al. |
| 6,554,270 | B2 | 4/2003 | Yamamoto |
| 7,229,070 | B2 | 6/2007 | Nakano |
| 7,240,899 | B2 | 7/2007 | Amamoto |
| 2004/0070136 | A1 | 4/2004 | Chung |
| 2005/0087921 | A1 | 4/2005 | Aoki et al. |

FOREIGN PATENT DOCUMENTS

| | | |
|---|---|---|
| JP | A-7-144771 | 6/1995 |
| JP | Y2-2512325 | 7/1996 |
| JP | A-2001-80774 | 3/2001 |
| JP | A-2001-225965 | 8/2001 |
| JP | A-2001-341875 | 12/2001 |

*Primary Examiner*—Patrick H Mackey
*Assistant Examiner*—Luis Gonzalez
(74) *Attorney, Agent, or Firm*—Oliff & Berridge, PLC

(57) ABSTRACT

When a paper feed cassette is again mounted, a pressing portion of a pressing member is brought into contact from the front side on a second surface of an extending portion of a contacting member, and the contacting member is pressed by the pressing member to be displaced from the retract position to the contact position. At this time, the pressing portion of the contacting member presses a pressed portion of a disc member to rotate a third cam itself in the counterclockwise direction in the drawing. Accordingly, the lift lever locked by the third cam is released, and an end portion of an arm member is allowed to move upward.

5 Claims, 20 Drawing Sheets

SHEET SUPPLY DEVICE AND IMAGE FORMING APPARATUS

This is a Division of application Ser. No. 11/288,192 filed Nov. 29, 2005, which claims the benefit of Japanese Patent Application No. 2004-347642 filed Nov. 30, 2004. The disclosures of the prior applications are hereby incorporated by reference herein in their entirety.

TECHNICAL FIELD

Aspects of the present invention relate to a sheet supply device and an image forming apparatus, and more specifically, to the driving control of a stacking portion on which sheets are stacked.

BACKGROUND

For example, in JP-A-2001-80774, there is disclosed a sheet supply device including: a pick-up roller (delivery roller) which is provided to be movable up and down so as to be brought into contact with sheets stacked on a stacking portion, and a separation mechanism having a paper feed roller (separation roller) and a separation pad (separation unit), which is provided in the more downstream side of the conveying direction than the pick-up roller. The pick-up roller is rotated in a state of being brought into contact with the sheet on the stacking portion, so that the sheet is delivered to the separation mechanism. Further, the sheets are separated one by one by the nip of the separation pad and the separation roller to be delivered to the more downstream side of the conveying direction.

Here, when the pick-up roller always is brought into contact with the sheet, there is a problem in that paper powder or conveying sound are produced or the conveying burden is increased by the friction between the pick-up roller and the sheet. Subsequently, in the sheet supply device of JP-A-2001-80774, when the sheet reaches the nip position between the paper feed roller and the separation roller, a solenoid switch is turned on to separate the pick-up roller from the sheet on the stacking portion.

SUMMARY

However, in order to miniaturize a device and reduce a cost, it is preferable that the separation operation of the pick-up roller be performed by the gear control without a dedicated detecting sensor being used, while the position of the pick-up roller is mechanically detected. In this construction, a stacking portion is lifted based on the position of the pick-up roller. Specifically, the stacking portion is driven to be lifted, and the driving is turned off when the pick-up roller to be brought into contact with the sheet on the stacking portion is placed at a predetermined height. When the number of papers decreases so that the pick-up roller is moved down to a predetermined position, the stacking portion is driven again to be lifted.

However, in this construction, for example, when a storage cassette having the stacking portion is set again to replenish sheets, the pick-up roller is positioned at the initial position to be separated from the sheet, and the stacking portion is positioned in the lowest point. As described above, the lifting drive of the stacking portion is switched based on the position of the pick-up roller. Therefore, when the gear mechanism has not been previously driven, the lifting drive of the stacking portion does not start, so that there is a problem in that a supply error (pick-up error) of sheet or delay of the supply operation occurs.

Aspects of the invention provide a sheet supply device which can stably perform a supply operation, even when a storage cassette is set again, and an image forming apparatus.

According to an aspect of the invention, there is provided a sheet supply device including: a device main body; a storage cassette that has a stacking portion capable of moving up and down, on which sheets are stacked, the storage cassette being configured to be pulled out of the device main body; a delivery roller that is provided to be movable up and down and is rotated in a state where the delivery roller is brought into contact with the sheet stacked on the stacking portion, so as to deliver the sheet to a downstream side of a conveying direction thereof; a separation unit that is provided at the downstream side of the conveying direction with respect to the delivery roller; a separation roller that is rotated in a state where the sheet delivered by the delivery roller is interposed between the separation unit and the separation roller, so as to separate the sheets one by one and supply; a stacking portion lifting mechanism that lifts the stacking portion while the delivery roller is placed at a delivery position where the delivery roller is brought into contact with the sheet stacked on the stacking portion, on the condition that the delivery roller is moved lower than a predetermined height; a gear mechanism that receives a supply start signal of sheet to rotate and control the delivery roller; a delivery roller switching unit that receives the supply start signal to displace the delivery roller from an initial position, where the delivery roller is separated from the stacking portion, to the delivery position and then returns the delivery roller to the initial position while the sheet passes between the separation unit and the separation roller; and a delivery-roller forcibly-displacing unit that forcibly displaces the delivery roller from the initial position to the delivery position, when the storage cassette is attached to the device main body.

The term 'sheet' may include other sheets, for example, paper money, in addition to a paper or OHP sheet as a recording medium.

The term 'sheet supply device' may be or may not be mounted detachably to a main body of an image forming apparatus (such as a printer, a facsimile, or a multifunction printer having a printer function, a scanner function and the like). In addition, the invention is not limited to a device for supplying sheets to a main body of the image forming apparatus, but may be provided in a device for counting sheets such as paper money or the like.

According to the aspect of the invention, when the storage cassette is mounted again on the device main body after sheets are replenished, the delivery roller is forcibly displaced from the initial position to the delivery position to be brought into contact with the sheet stacked on the stacking portion by the delivery-roller forcibly-displacing unit. At this time, the delivery roller is placed lower than a predetermined height and the stacking portion is lifted by the stacking portion lifting mechanism, so that the sheet can be promptly ready to be supplied at the time of supply start of the next sheet.

BRIEF DESCRIPTION OF THE DRAWINGS

Illustrative aspects of the invention may be more readily described with reference to the accompanying drawings.

DETAILED DESCRIPTION

Hereinafter, an embodiment of the invention will be described with reference to FIGS. 1 to 20.

1. Overall Construction of Present Embodiment

Figure 1:
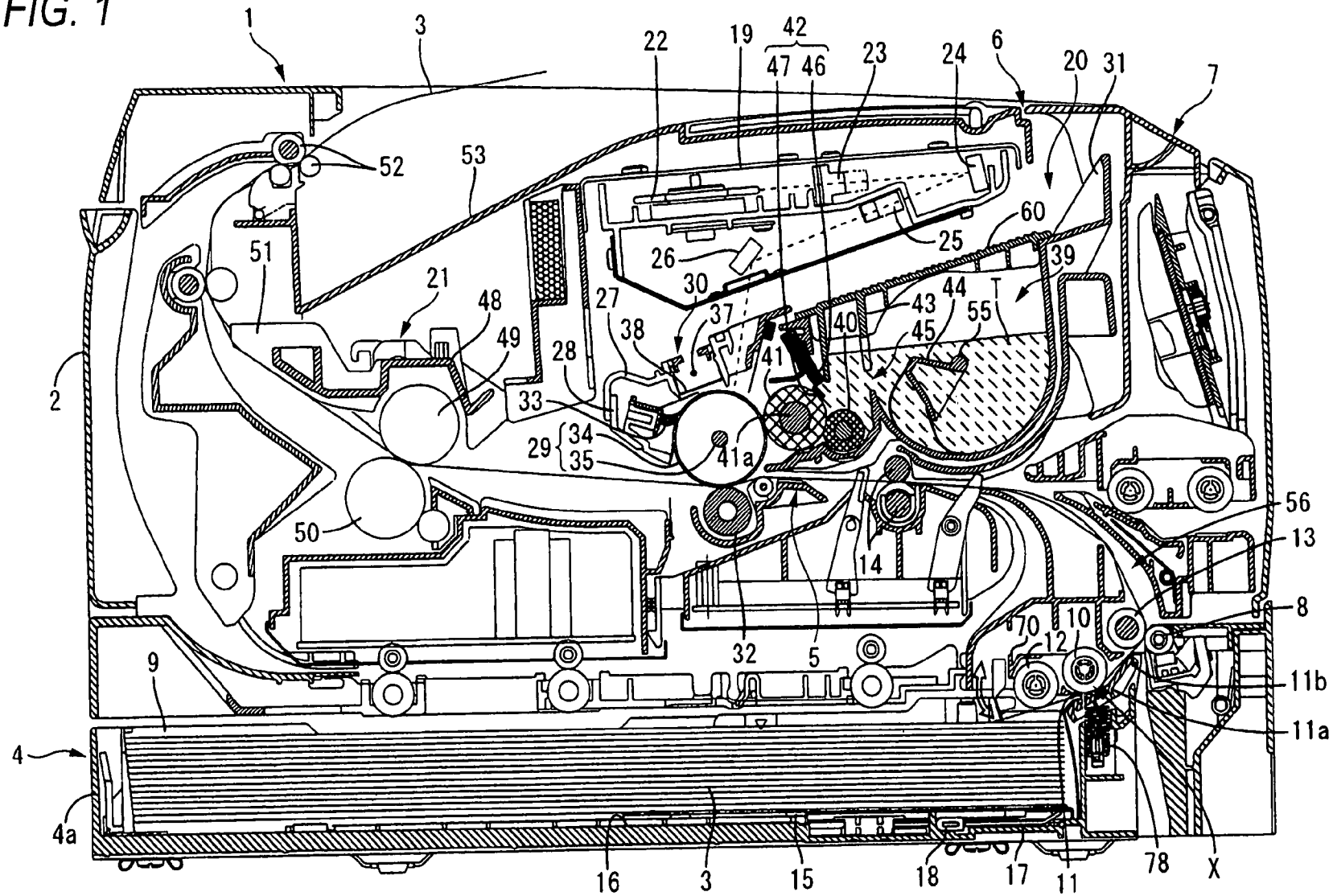
FIG. 1 is a cross-sectional view showing essential parts of a laser printer according to an embodiment of the invention.

FIG. 1 is a side cross-sectional view showing essential parts of a laser printer as an image forming apparatus. The laser printer 1 is provided with a main body casing 2, a feeder portion 4 (a sheet supply device) which is housed in the main body casing 2 to feed a paper 3 as a sheet, and an image forming portion 5 (an image forming unit) which forms an image on the fed paper 3.

(1) Main Body Casing

On one side wall of the main body casing 2, an attaching/detaching opening 6 through which a process cartridge 20 to be described below is attached and detached is formed, and a front cover 7 for opening and closing the attaching/detaching opening 6 is provided. The front cover 7 is rotatably supported by a cover shaft (not shown) inserted into the lower end portion thereof. Accordingly, when the front cover 7 is closed about the cover shaft, the attaching/detaching opening 6 is closed by the front cover 7, as shown in FIG. 1. When the front cover 7 is opened (inclined) with the cover shaft being a supporting point, the attaching/detaching opening 6 is opened. Through the attaching/detaching opening 6, the process cartridge 20 can be attached to and detached from the main body casing 2.

Hereinafter, in a state where the process cartridge 20 is housed in the main body casing 2, the side where the front cover 7 is provided indicates 'front side/front surface', and the side opposite thereto indicates 'rear side/rear surface'.

(2) Feeder Portion

In the lower portion of the main body casing 2, a feeder portion 4 is provided with a paper feed cassette 9 (a storage cassette) which is mounted to be pulled out, a separation roller 10 and separation pad 11 (a separation unit) which are provided in the upper side of the front end portion of the paper feed cassette 9, and a paper feed roller 12 (a delivery roller) which is provided in the rear side (the upstream side of the conveying direction of paper 3 with respect to the separation pad 11) of the separation roller 10. Further, the feeder portion 4 is provided with a paper powder removing roller 8 which is disposed at the front upper side (the downstream side of the conveying direction of the paper 3 with respect to the separation roller) of the separation roller 10 so as to be opposite thereto and a counter roller 13 which is disposed to be opposite to the paper powder removing roller 8.

A conveying path 56 of paper 3 is folded rearward in U-shape near the paper powder removing roller 8, and a pair of registration rollers 14 are provided in the lower side of the process cartridge 20 at the downstream side of the conveying direction.

Inside the paper feed cassette 9, a paper urging plate 15 (a stacking portion) is provided, on which the papers 3 can be placed in a stacked manner. The rear end portion of the paper urging plate 15 is swingably supported, so that the paper urging plate 15 is swingable from the stacking position (a state of FIG. 1) to the supply position (states of FIGS. 11 to 14). In the stacking position, the front end portion thereof is disposed in the lower side so that the paper urging plate is placed along a bottom portion 16 of the paper feed cassette 9 and, in the supply position, the front end portion is disposed in the upper side so that the paper urging plate is inclined.

In addition, in the front end portion of the paper feed cassette 9, a lever 17 for lifting the front end portion of the paper urging plate 15 upward is provided. In the lever 17, the rear end portion thereof is swingably supported by a lever shaft 18 in the lower position of the front end portion of the paper urging plate 15, so that the lever 17 is swingable between the lying-down posture (a state shown in FIG. 1), where the front end portion lies down on the bottom portion 16 of the paper feed cassette 9, and the inclined posture (states shown in FIGS. 11 to 14) where the front end portion lifts the paper urging plate 15. When a rotational driving force in the counterclockwise direction in FIG. 1 is applied to the lever shaft 18, the lever 17 is rotated about the lever shaft 18 being a supporting point. Then, the front end portion of the lever 17 lifts the front end portion of the paper urging plate 15 so that the paper urging plate 15 is moved to the supply position.

When the paper urging plate 15 is positioned in the supply position, the paper 3 on the paper urging plate 15 is pressed against the paper feed roller 12, and the paper starts to be fed toward the separation position X between the separation roller 10 and the separation pad 11 by the rotation of the paper feed roller 12.

In the meantime, when the paper feed cassette 9 is pulled out of the feeder portion 4, the front end portion of the paper urging plate 15 is moved downward to be positioned in the stacking position, so that the papers 3 can be placed in a stacked manner on the paper urging plate 15. Moreover, the separation pad 11, the paper powder removing roller 8, the paper urging plate 15, and the lever 17 are provided in the paper feed cassette 9. The paper feed roller 12, the separation roller 10, the counter roller 13, and the pair of registration rollers 14 are provided in the main body casing 2. The feeder portion 4, excluding the paper cassette 9, functions as a device main body. As shown in FIG. 1, the paper feed cassette 9 is inserted into the device main body 4*a* to be disposed in a regular housing position so that the mounting thereof is completed, which is referred to 'a state where the paper feed cassette is attached to the device main body'.

The papers 3 which are delivered toward the separation position X by the paper feed roller 12 are separated one by one to be fed by the rotation of the separation roller 10, when being interposed in the separation position X between the separation roller 10 and the separation pad 11. The fed paper 3 is folded along the U-shaped conveying path 56. More specifically, the fed paper 3 first passes through the separation position X between the separation roller 10 and the separation pad 11 to be conveyed upward. Further, the paper 3 passes between the paper powder removing roller 8 and the counter roller 13, while paper dust is removed here. Then, the paper 3 is fed into the registration roller 14. The paper feed direction of the paper 3 corresponds to 'the conveying direction of sheet'.

After registration of the paper 3, the registration roller 14 conveys the paper 3 to the transfer position, where a toner image on a photosensitive drum 29 is transferred onto the paper 3, between the photosensitive drum 29 and a transfer roller 32, which will be described below.

(3) Image Forming Portion

The image forming portion 5 is provided with a scanner portion 19, a process cartridge 20, and a fixing portion 21.

(a) Scanner Portion

The scanner portion 19, which is provided at the upper portion in the main body casing 2, is provided with a laser light source (not shown), a polygon mirror 22 that is rotationally driven, an fθ lens 23, a reflecting mirror 24, a lens 25, and a reflecting mirror 26. As shown by the chained line, a laser beam based on image data to be emitted from the laser light source is deflected by the polygon mirror 22 to pass through the fθ lens 23. Then, the laser beam is reflected by the reflecting mirror 24 and passes through the lens 25. Further, the laser beam is refracted downward by the reflecting mirror 26, and then irradiated on the surface of the photosensitive drum 29 of the process cartridge 20 to be described below.

(b) Process Cartridge

The process cartridge 20 is mounted detachably with respect to the main body casing 2 in the lower side of the scanner portion 19. The process cartridge 20 is provided with an upper frame 27 and a lower frame 28 which is formed separately from the upper frame 27 and combined with the upper frame 27, as a case. In addition, the process cartridge 20 is provided with the photosensitive drum 29, a scorotron-type charger 30, a developing cartridge 31, a transfer roller 32, and a cleaning brush 33 inside the case.

The photosensitive drum 29, which is formed in a cylindrical shape, is provided with a drum main body 34, which is formed of positively-charged photosensitive layers of which the uppermost layer is made of polycarbonate, and a metallic drum shaft 35 serving as a shaft which extends along the longitudinal direction of the drum main body 34 in the center of the axis of the drum main body 34. The drum shaft 35 is supported by the upper frame 27 and the drum main body 34 is supported to rotate about the drum shaft 35, so that the photosensitive drum 29 is provided to rotate about the drum shaft 35 in the upper frame 27.

The scorotron-type charger 30, which is supported by the upper frame 27, is disposed at a predetermined interval so as not to be brought into contact with the photosensitive drum 29 and so as to be opposite to the photosensitive drum 29 in the rearward-oblique and upper side of the photosensitive drum 29. The scorotron-type charger 30 is provided with a discharge wire 37, which is disposed at a predetermined interval to be opposite to the photosensitive drum 29, and a grid 38 which is provided between the discharge wire 37 and the photosensitive drum 29 to control an amount of discharge from the discharge wire 37 to the photosensitive drum 29. By the scorotron-type charger 30, a bias voltage is applied to the grid 38, and a high voltage is applied to the discharge wire 37 at the same time. Then, the discharge wire 37 is corona-discharged, so that the surface of the photosensitive drum 29 can be uniformly and positively charged.

The developing cartridge 31 is provided with a box-shaped housing case 60, of which the rear side is opened, and is mounted detachably with respect to the lower frame 28. Inside the developing cartridge 31, a toner containing chamber 39, a toner supply roller 40, a developing roller 41, and a thickness regulating blade 42 are provided.

The toner containing chamber 39 is formed as an inner space in the front side of the housing case 60, which is partitioned by a partitioning plate 43. The toner containing chamber 39 is filled with non-magnetic mono-component positive polymerization toner T as developer.

In addition, inside the toner containing chamber 39, an agitator 44 is provided, which is supported by a rotating shaft 55 provided in the center thereof. The agitator 44 is. rotationally driven by the input of power from a motor (not shown). When the agitator 44 is rotationally driven, the toner T within the toner containing chamber 39 is agitated to be discharged toward the toner supply roller 40 from an opening portion 45 which communicates in the front and rear direction in the lower side of the partitioning plate 43.

The toner supply roller 40 is disposed in the rear side of the opening portion 45 so as to be rotatably supported by the developing cartridge 31. The toner supply roller 40 is formed by coating a metallic roller shaft with a roller made of a conductive foam material. The toner supply roller 40 is rotationally driven by the input of power from a motor (not shown).

The developing roller 41 is rotatably supported by the developing cartridge 31 at the rear side of the toner supply roller 40 in a state where the developing roller 41 is brought into contact with the toner supply roller 40 so as to be pressed against the toner supply roller 40. In addition, the developing roller 41 is brought into contact with the photosensitive drum 29 opposite thereto, in a state where the developing cartridge 31 is mounted on the lower frame 28. The developing roller 41 is formed by coating a metallic roller shaft 41*a* with a roller made of a conductive rubber material. Both end portions of the roller shaft 41*a* project outward in the width direction orthogonal to the front and rear direction from the side surface of the developing cartridge 31 at the rear end portion of the developing cartridge 31. A developing bias is applied to the developing roller 41 at the time of developing. In addition, the developing roller 41 is rotationally driven in the same direction as the toner supply roller 40 by the input of power from a motor (not shown).

The thickness regulating blade 42 is provided with a pressing portion 47, which is made of insulating silicon rubber and has semi-circular cross section, at the leading end portion of the blade main body 46 made of a metallic plate spring. The thickness regulating blade 42 is supported at the upper side of the developing roller 41 by the developing cartridge 31, and the pressing portion 47 is pressed against the developing roller 41 by an elastic force of the blade main body 46.

The toner T discharged from the opening portion 45 is supplied to the developing roller 41 by the rotation of the toner supply roller 40. At this time, the toner T is positively friction-charged between the toner supply roller 40 and the developing roller 41. The toner T supplied onto the developing roller 41 enters between the pressing portion 47 of the thickness regulating blade 42 and the developing roller 41 with the rotation of the developing roller 41 so as to be carried as a thin layer having a certain thickness on the developing roller 41.

The transfer roller 32 is rotatably supported by the lower frame 28. In a state where the upper frame 27 and the lower frame 28 are combined, the transfer roller 32 is brought into contact with the photosensitive drum 29 opposite thereto in the up and down direction and is disposed so as to form a nip between the photosensitive drum 29 and the transfer roller 32. The transfer roller 32 is formed by coating a metallic roller shaft 32*a* with a roller made of a conductive rubber material. A transfer bias is applied to the transfer roller 32 at the time of transferring. In addition, the transfer roller 32 is rotationally driven in the reverse direction to the photosensitive drum 29 by the input of power from a motor (not shown).

The cleaning brush 33 is mounted on the lower frame 28. In a state where the upper frame 27 and the lower frame 28 are combined with each other, the cleaning brush 33 is disposed so as to be brought into contact with the photosensitive drum 29 opposite thereto at the rear side of the photosensitive drum 29.

With the rotation of the photosensitive drum 29, first, the surface of the photosensitive drum 29 is uniformly and positively charged by the scorotron-type charger 30. Then, the surface is exposed by a high-speed scanning of laser beam from the scanner portion 19, so that an electrostatic latent image corresponding to an image to be formed is formed on the paper 3.

Next, by the rotation of the developing roller 41, the toner, which is carried on the developing roller 41 and positively charged, is brought into contact with the photosensitive drum 29. At this time, the toner is supplied to an electrostatic latent image which is formed on the surface of the photosensitive drum 29, that is, an exposed portion, which is exposed to a laser beam so that an electric potential thereof falls down, on the surface of the photosensitive drum 29 which is uniformly and positively charged. Therefore, the electrostatic latent image of the photosensitive drum 29 is developed and, on the surface of the photosensitive drum 29, a toner image caused by the inversion developing is carried.

After that, as shown in FIG. 1, the toner image carried on the surface of the photosensitive drum 29 is transferred onto the paper 3 by the transfer bias applied to the transfer roller 32, while the paper 3 to be conveyed by the resist roller 14 passes through the transfer position between the photosensitive drum 29 and the transfer roller 32. The paper 3 on which the toner image is transferred is conveyed to the fixing portion 21.

(c) Fixing Portion

The fixing portion 21, which is provided in the rear side of the process cartridge 20, is provided with a fixing frame 48. Inside the fixing frame 48, a heating roller 49 and a pressurizing roller 50 are provided.

In the fixing portion 21, the toner transferred onto the paper 3 is thermally fixed at the transfer position, while the paper 3 passes between the heating roller 49 and the pressurizing roller 50. The paper 3 on which the toner is fixed is conveyed to a paper discharge path 51 which extends in the up and down direction toward the upper surface of the main body casing 2. The paper 3 conveyed to the paper discharge path 51 is discharged by a paper discharge roller 52 provided in the upper side thereof onto a paper discharge tray 53 which is formed on the upper surface of the main body casing 2.

2. Construction of Separation Roller and Separation Pad

Figure 2:
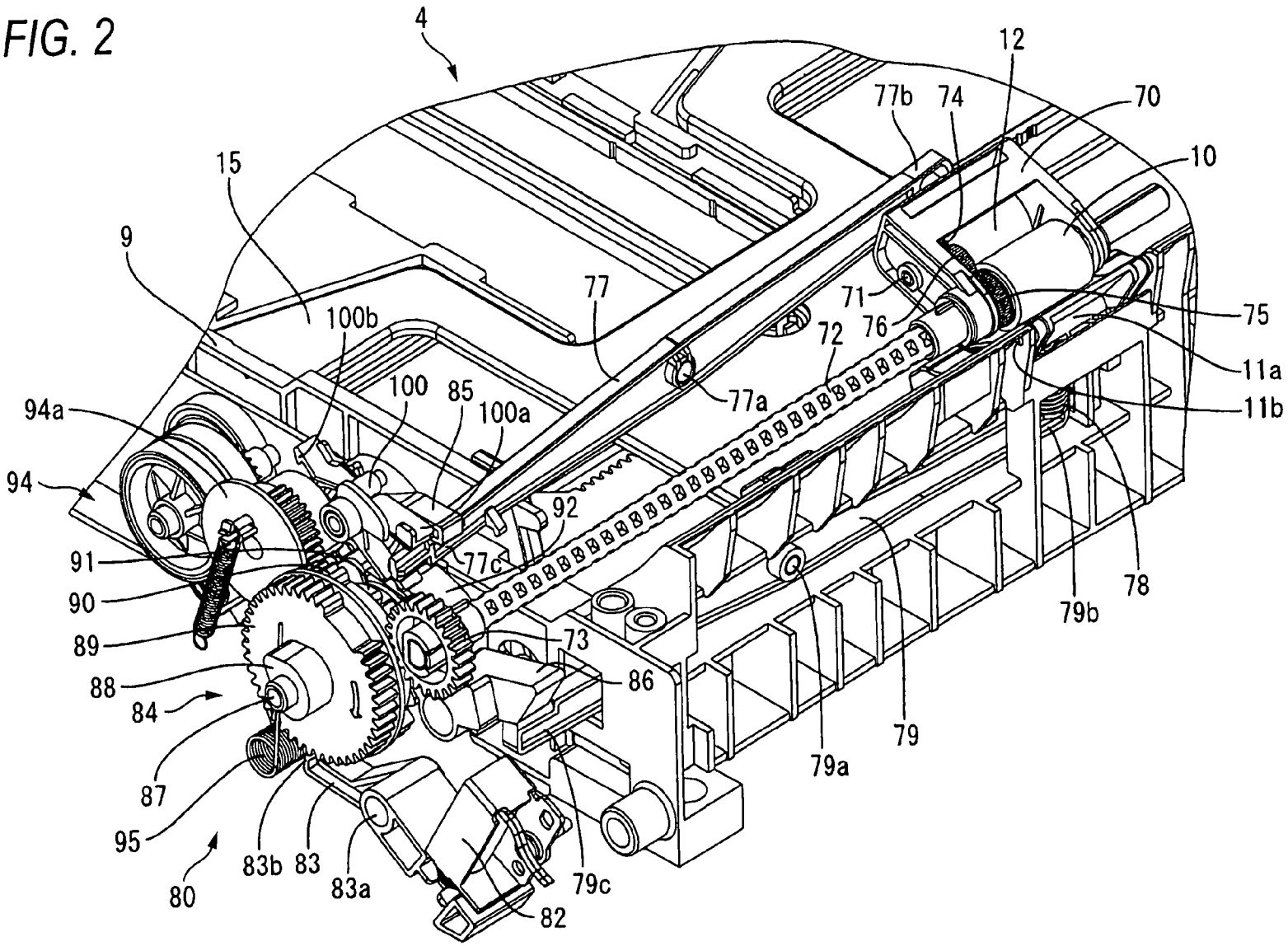
FIG. 2 is a perspective view showing a gear mechanism section as viewed from the front side.

FIG. 2 is a perspective view showing a gear mechanism section as viewed from the front side. In FIG. 2, the right-lower side indicates the front side of the laser printer 1, and the left-lower side indicates the rear side of the laser printer 1.

As shown in FIG. 2, the paper feed roller 12 and the separation roller 10 are rotatably born with respect to a roller bearing member 70 in a state where the respective ones of rotating shaft bodies 71 and 72 are provided in a line along the direction orthogonal to the conveying direction. Moreover, the rotating shaft bodies 71 and 72 are formed of resin and, on the outer circumferential surface thereof, concaves for preventing sink marks are formed. In the mean time, one end portion of the rotating shaft body 72 of the separation roller 10 penetrates one side wall (the left-hand side in FIG. 2) of the roller bearing member 70, and a separation roller gear 73 is integrally provided in the leading end portion thereof. The separation roller gear 73 receives a driving force from a gear mechanism 80 to be described below so that the rotating shaft body 72 rotates. With the rotation of the rotating shaft body 72, the separation roller 10 is integrally rotated.

In addition, the paper feed roller 12 side of the roller bearing member 70 swings (the white blank arrow direction in FIG. 1) about the rotating shaft body 72 of the separation roller 10. By the rotation of the lever shaft 18, the paper urging plate 15 is driven upward. Then, the paper feed roller 12 swings upward in a state where the surface of the uppermost paper 3 among the papers stacked on the paper urging plate 15 is brought into contact with the lower side of the paper feed roller 12.

In addition, on the same shafts of the paper feed roller 12 and the separation roller 10, gears 74 and 75 are provided to integrally rotate with the respective rotating shaft bodies 71 and 72. Further, through a connection gear 76 which is engaged with the gears 74 and 75, both of the rollers 10 and 12 are interlocked to be rotated. Specifically, with the separation roller 10 rotating, the separation roller 12 is dependently rotated.

3. Switching Unit of Paper Feed Roller

As shown in FIG. 2, in the rear side (the left and upper side in the drawing) of the rotating shaft body 72, an arm member 77, which is parallel to the rotating shaft body 72, is provided so that the substantially central position 72*a* thereof is rotatably supported. Further, in the arm member 77, one end portion 77*b* thereof is engaged with the swinging end side of the roller bearing member 70, in which the paper feed roller 12 is provided, and the other end portion 77*c* is engaged with the gear mechanism 80.

Figure 3:
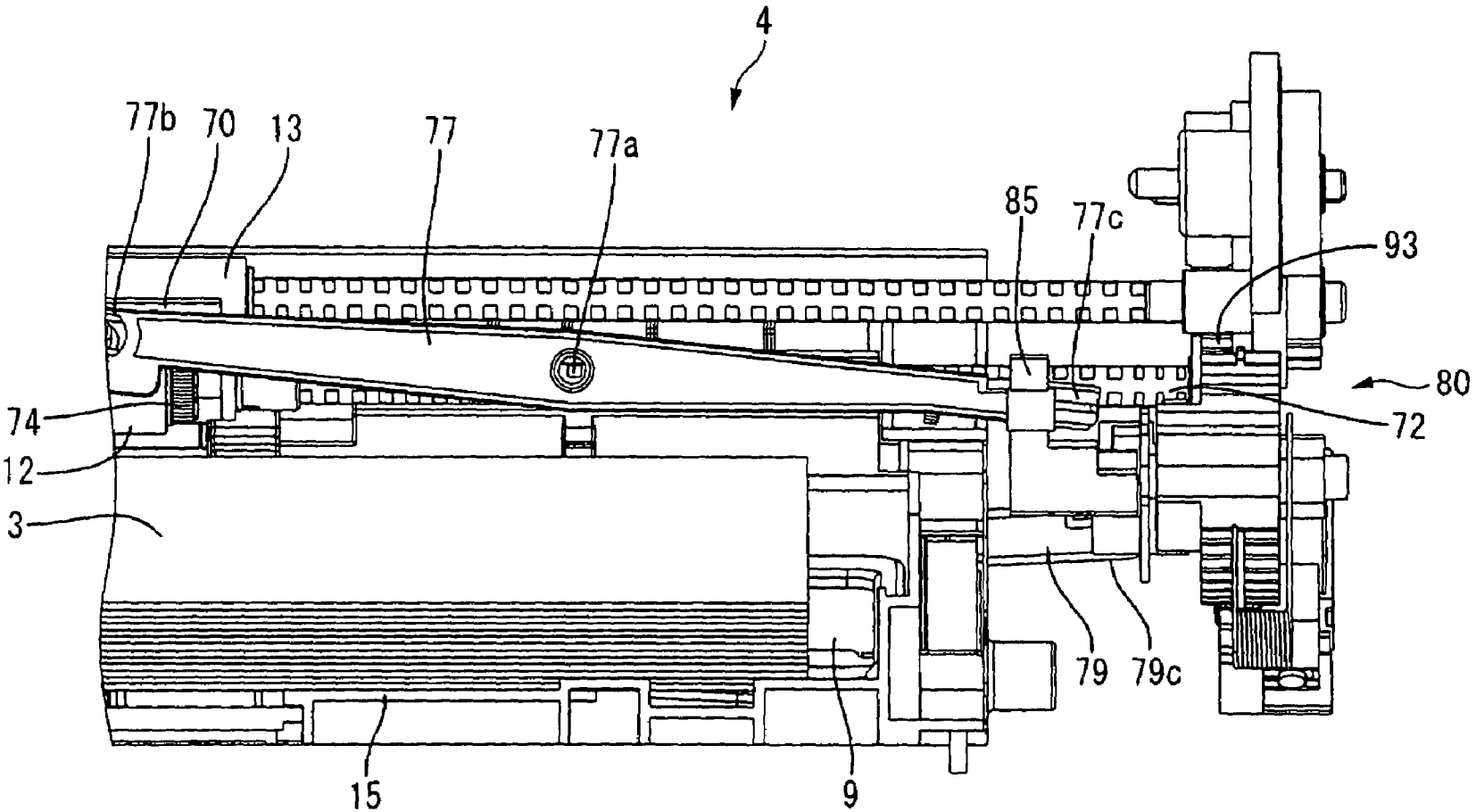
FIG. 3 is a view showing a feeder portion as viewed from the rear side (a state where a paper feed roller is placed in an initial position)
Figure 4:
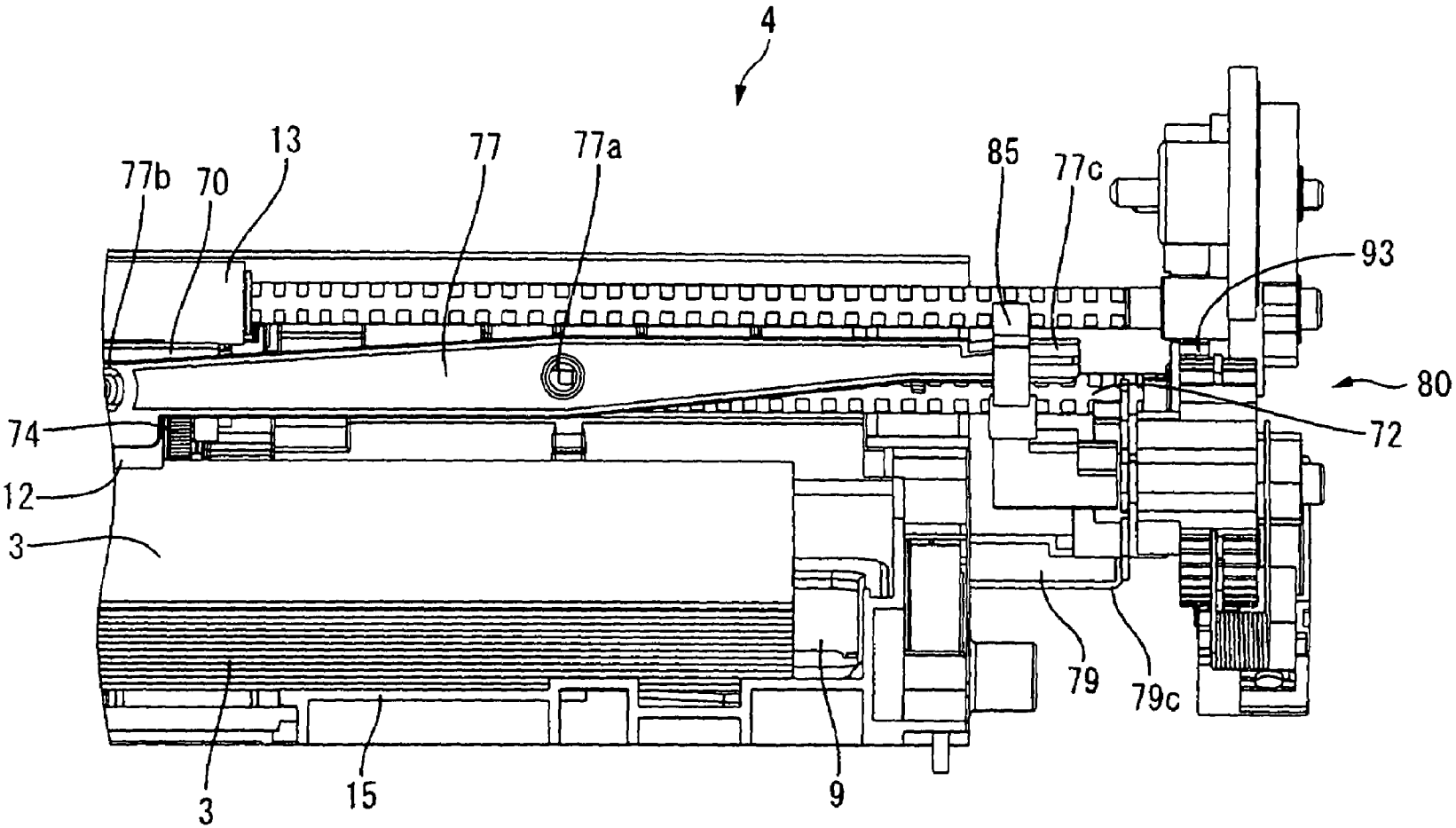
FIG. 4 is a view showing the feeder portion as viewed from the rear side (a state where the paper feed roller is placed in a paper feed position)

FIG. 3 is an elevational view showing the feeder portion 4 as viewed from the rear side (a state where the paper feed roller 12 is placed in a separation position, that is, 'the initial position'), and FIG. 4 is an elevational view showing the feeder portion 4 as viewed from the rear side (a state where the paper feed roller 12 is placed in a contact position, that is 'the delivery position', and hereinafter referred to as 'the paper feed position'). In the drawings, the near side in a direction perpendicular to the sheet of FIGS. 3 and 4 indicates the rear end of the laser printer 1, and the far side indicates the front end of the laser printer 1.

With such a structure, as shown in FIG. 3, the other end 77*c* of the arm member 77 is pushed down by the gear mechanism 80, so that the paper feed roller 12 is moved to the initial position to be separated from a pile of papers stacked on the paper urging plate 15. On the contrary, as shown in FIG. 4, the pushing force by the gear mechanism 80 is released, so that the paper feed roller 12 droops in the lower direction due to its own weight to move to the paper feed position to be brought into contact with the pile of papers stacked on the paper urging plate 15.

4. Pressure Changing Unit between Separation Pad and Separation Roller

As shown in FIG. 1, the separation pad 11 lays on a rectangular arrangement plate 11*a*, and the front end portion of the arrangement plate 11*a* is rotatably supported by a supporting shaft 11*b* so that the rear end portion is swingable. In the lower side of the arrangement plate 11*a*, the lower surface of the arrangement plate 11*a* is pressed from the lower side toward the upper side by a spring member 78 (for example, coil spring). By the biasing force of the spring member 78, the separation pad 11 is pressed against the separation roller 10.

In addition, as shown in FIG. 2, in the lower side of the rotating shaft body 72, an arm member 79, which is parallel to the rotating shaft body 72, is provided so that the substantially central position 79*a* thereof is rotatably supported. Further, in the arm member 79, one end portion 79*b* is brought into contact with the lower end position of the spring member 78, and the other end portion 79*c* is engaged with the gear mechanism 80 to be described below.

Figure 5:
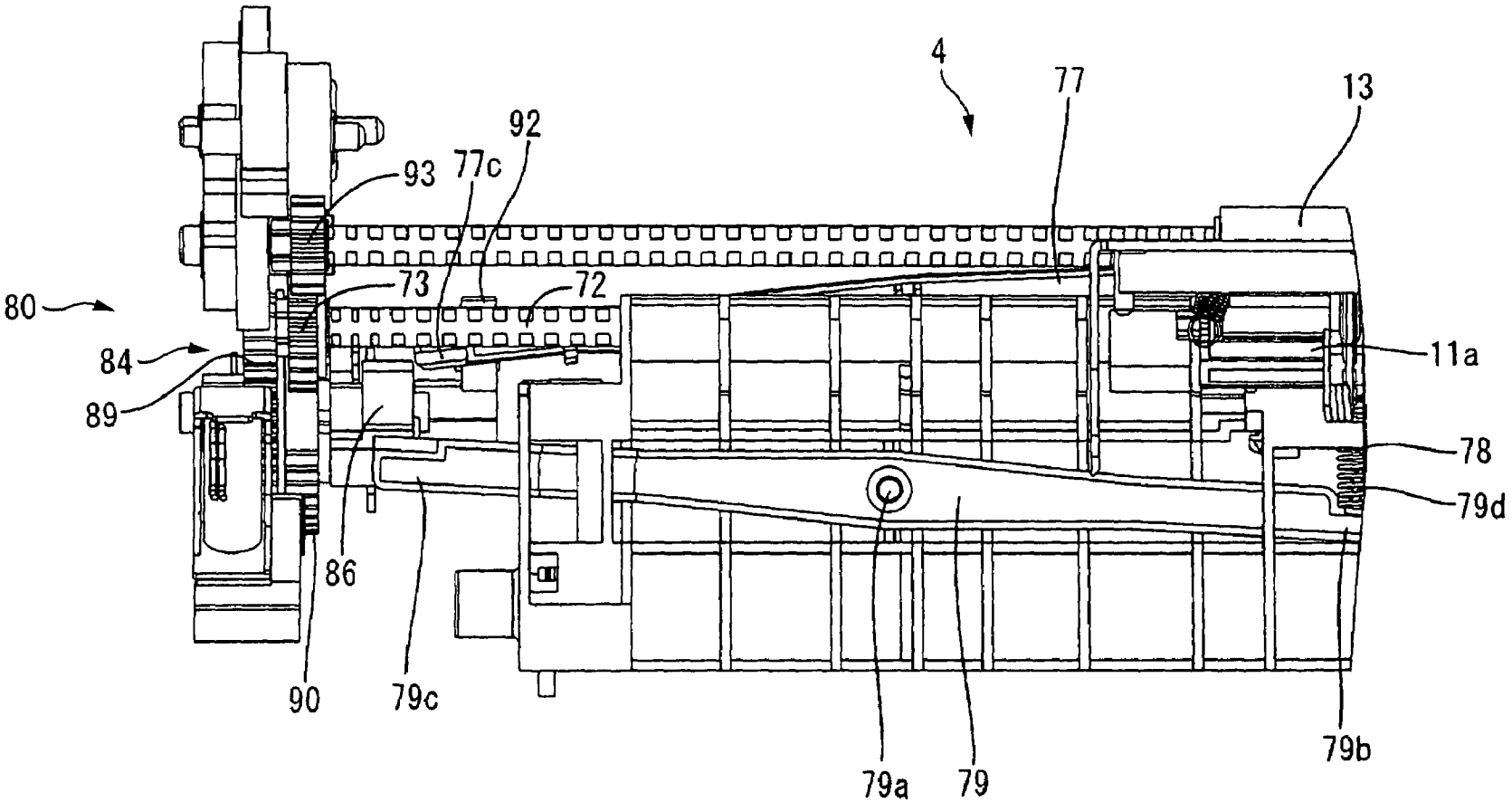
FIG. 5 is a front view showing the feeder portion as viewed from the front side (a low-pressure state)
Figure 6:
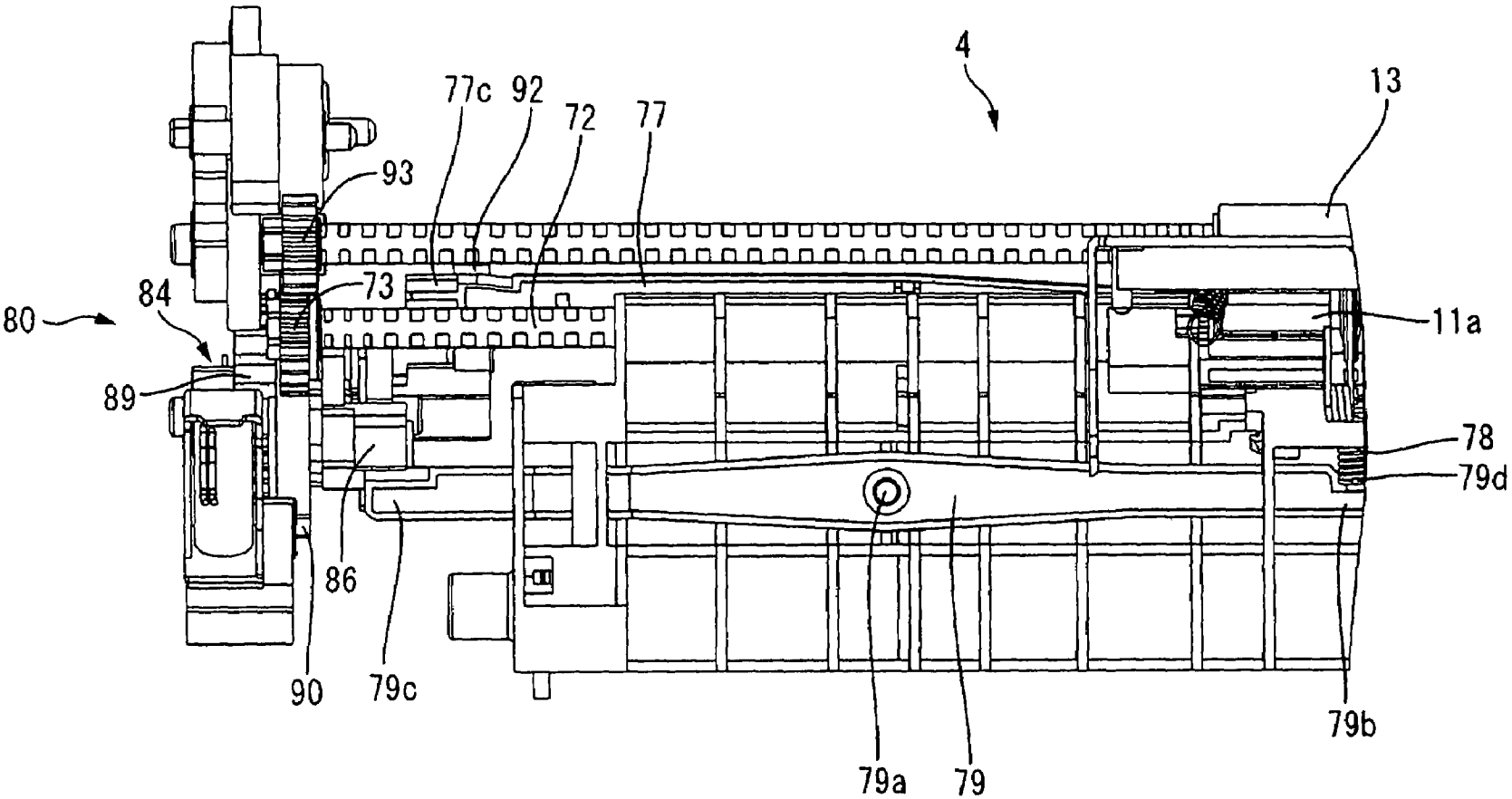
FIG. 6 is a front view showing the feeder portion as viewed from the front side (a high-pressure state)

FIG. 5 is an elevational view showing the feeder portion as viewed from the front side (a low-pressure state), and FIG. 6 is an elevational view showing the feeder portion as viewed from the front side (a high-pressure state). In the drawings, the near side in the direction perpendicular to the sheet of FIGS. 5 and 6 indicates the front end of the laser printer 1, and the far side indicates the rear end of the laser printer 1.

With such a structure, as shown in FIG. 5, when the other end portion 79*c* of the arm member 79 is positioned in the upper side, the one end portion 79*b* is positioned in the lower side, so that the spring member 78 is compressively deformed at the separation distance between the one end portion 79*b* and the rear surface of the arrangement plate 11*a* (hereinafter, this state is referred to as 'the low pressure state'). On the other hand, as shown in FIG. 6, when the other end portion 79*c* of the arm member 79 is moved downward, the one end portion 79*b* is moved upward to push up the lower end portion of the spring member 78, so that the spring member 78 is further compressively deformed. Therefore, the pressing force of the separation pad 11 against the separation roller 10 can be made stronger than in the low pressure state (hereinafter, this state is referred to as 'the high pressure state').

Moreover, as shown in FIGS. 5 and 6, a projecting portion 79*d* is provided to be erected upward on the one end portion 79*b* of the arm member 79 and inserted inside of the spring member 78 from the lower end. Therefore, the positional deviation between the one end portion 79*b* and the spring member 78 is regulated.

5. Gear Mechanism

Next, the gear mechanism 80 will be described. The gear mechanism 80 is provided with a plurality of gears which are rotated by a driving force from a driving motor (not shown) provided in the main body casing 2. The gear mechanism mainly controls the following operations.

(a) An operation (hereinafter, referred to as 'the roller driving operation') where the rotating shaft body 72 is rotated to rotate the separation roller 10 and the paper feed roller 12.

(b) An operation (hereinafter, referred to as 'the paper feed roller switching operation') where the end portion 77*c* of the arm member 77 is moved up and down to move the paper feed roller 12 up and down.

(c) An operation (hereinafter, referred to as 'the pressure reducing operation') where the end portion 79*c* of the arm member 79 is moved up and down to change the pressure between the separation roller 10 and the separation pad 11.

(d) An operation as a stacking portion lifting mechanism (hereinafter, referred to as 'the paper urging plate lifting operation') where, when the paper feed roller 12 is placed at the paper feed position, the lever 17 is rotated to lift the paper urging plate 15 until the paper feed roller 12 is placed at a predetermined height so as to feed a paper, and when the paper urging plate 15 reaches the predetermined height, the rotation of the lever 17 is stopped.

Specifically, the gear mechanism 80 is composed of the separation roller gear 73, an input gear 81, a solenoid switch 82, a solenoid lever 83, a sector gear 84, a lift lever 85, a separation lever 86, and the like, as shown in FIG. 2.

(1) Solenoid Switch and Solenoid Lever

Figure 7:
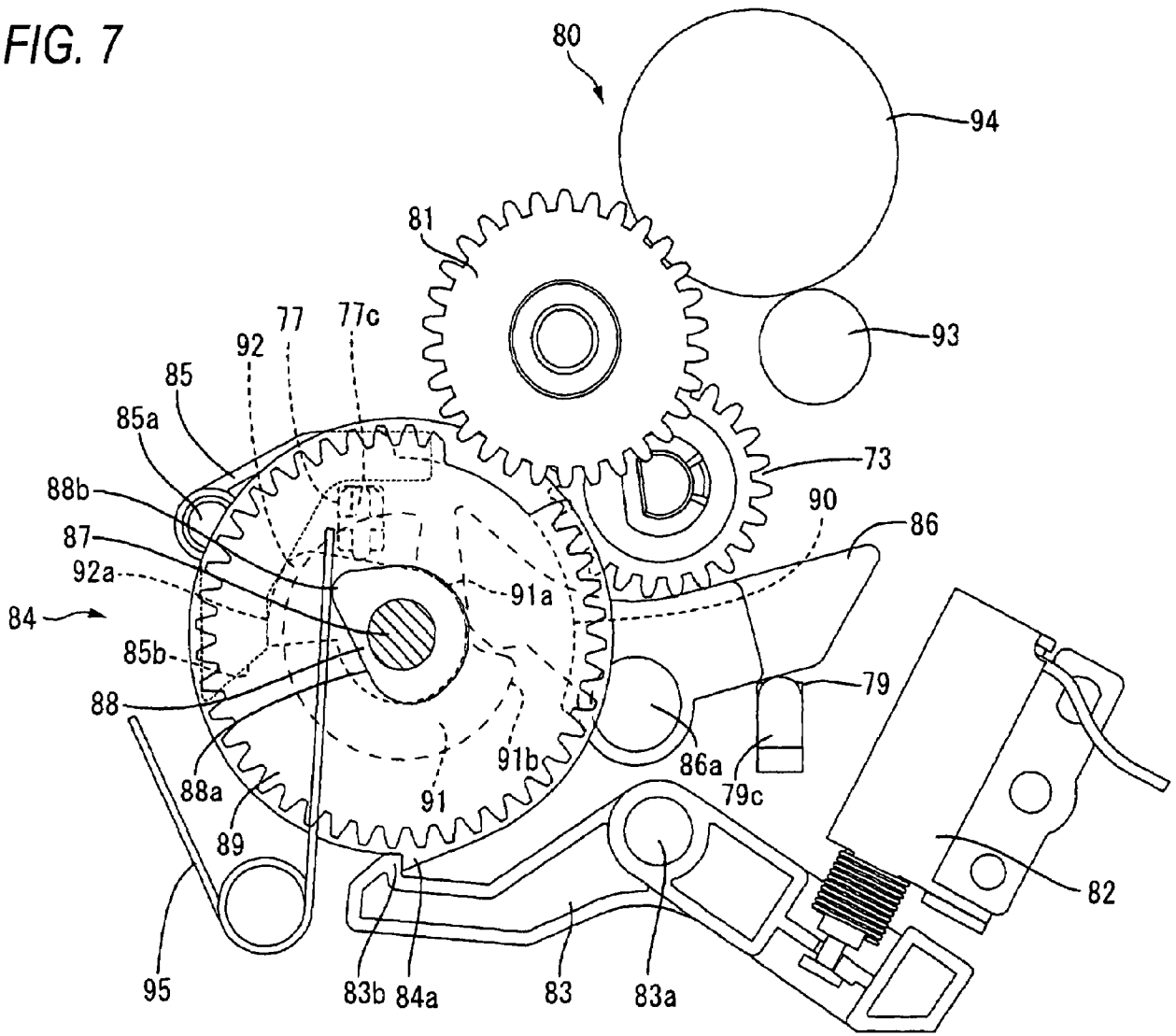
FIG. 7 is a diagram schematically showing the construction of a gear mechanism.
Figure 8:
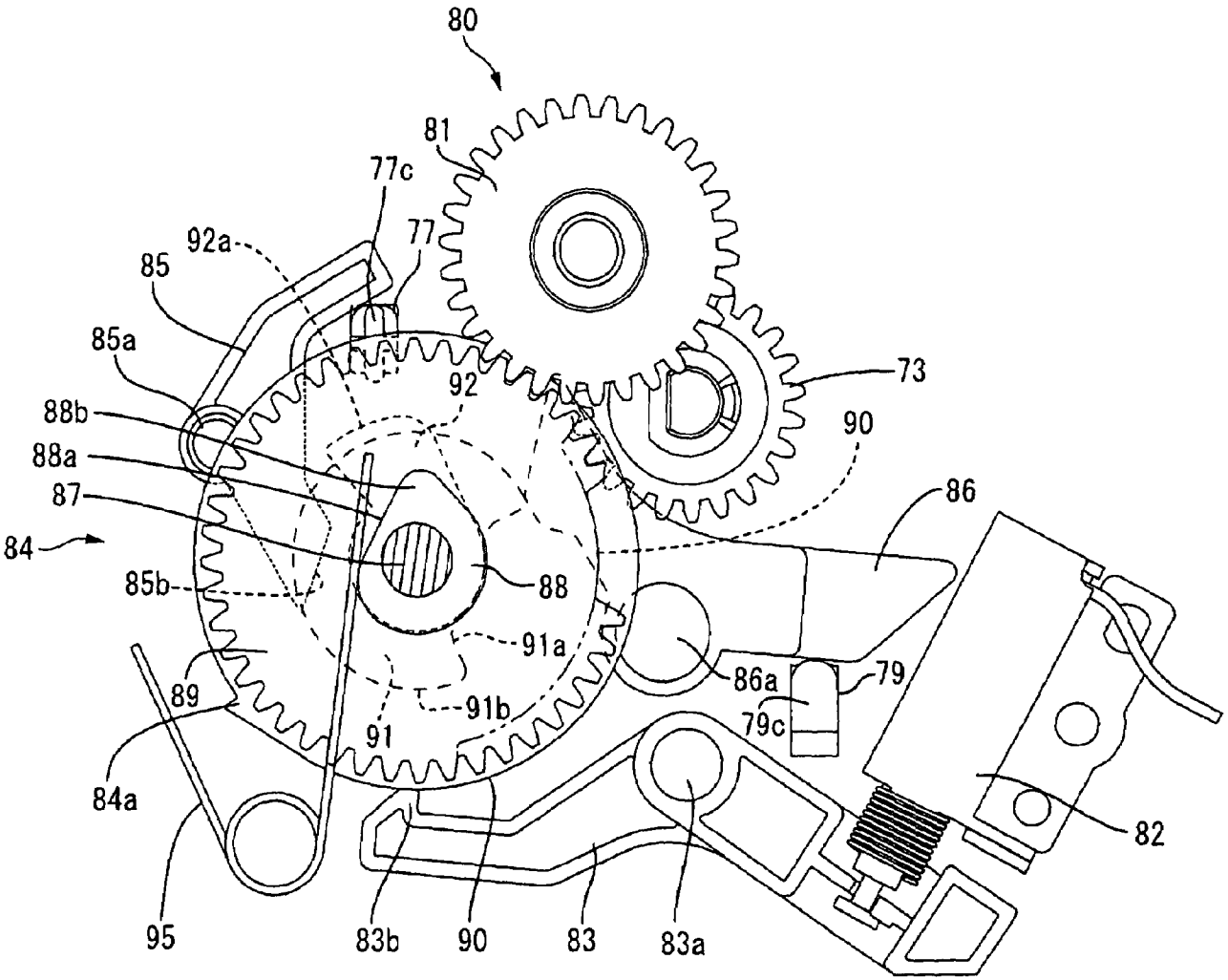
FIG. 8 is another diagram schematically showing the construction of the gear mechanism.
Figure 9:
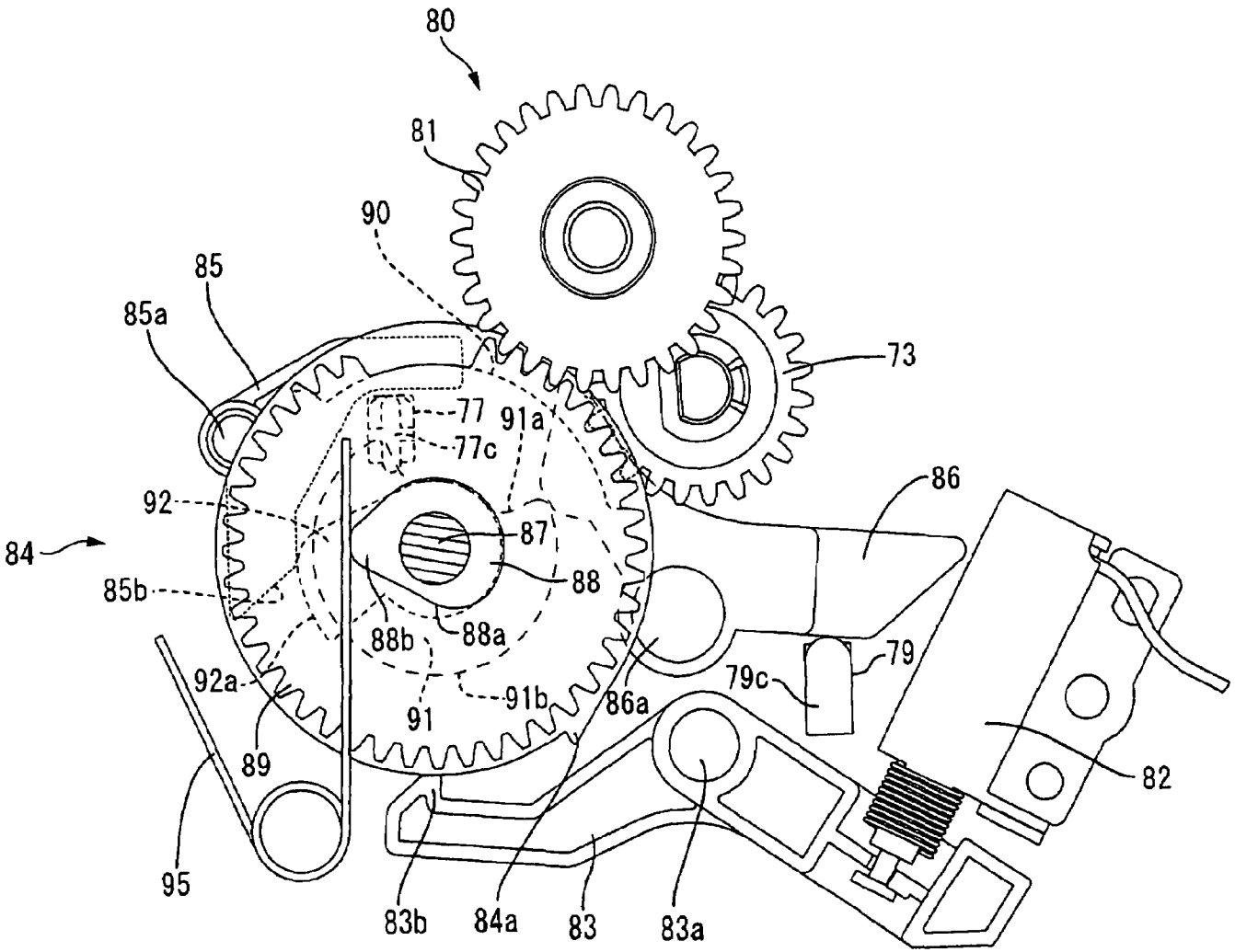
FIG. 9 is still another diagram schematically showing the construction of the gear mechanism.

FIGS. 7 to 9 are diagrams schematically showing the construction of the gear mechanism. In the drawings, the right-hand side indicates the front side of the laser printer 1, and the left-hand side indicates the rear side of the laser printer 1.

As also shown in FIG. 7, the solenoid switch 82 functions as switching unit which performs a turn-on operation whenever it receives an initiation signal (the supply start signal of sheet) of image forming operation. In the solenoid lever 83, the substantially central position 83*a* thereof is rotatably supported, and the front end portion thereof is lifted upward in accordance with the turn-on operation of the solenoid switch 82. In addition, in the rear end side of the solenoid lever 83, a locking claw 83*b* is integrally provided, which is engaged with a locking projection 84*a* projecting on the outer circumferential surface of the sector gear 84.

(2) Sector Gear

The sector gear 84 is composed of a first cam 88, a first teeth-chipped gear 89, a second teeth-chipped gear 90, a second cam 91, and a third cam 92 (the cam), which are integrally rotated about the same rotating shaft 87.

(a) First Teeth-Chipped Gear

More specifically, as shown in FIG. 7, the first teeth-chipped gear 89, of which a portion is continuously chipped, is rotationally driven by being engaged with the input gear 81 to which the driving force from the driving motor is input. Here, when the locking claw 83*b* of the solenoid lever 83 and the locking projection 84*a* of the sector gear 84 are engaged with each other, the teeth-chipped portion of the first teeth-chipped gear 89 is adjusted to be opposite to the input gear 81. Specifically, at this time, the driving force from the input gear 81 is not transmitted to the sector gear 84.

(b) First Cam

The first cam 88 is disposed in the right side (the left and lower side in FIG. 2, and the near side in FIG. 7) of the first teeth-chipped gear 89. In addition, the first cam 88, of which the cross-sectional surface orthogonal to the rotating shaft 87 is substantially D-shaped as a whole, is formed with a flat portion 88*a* and a flange 88*b*. The flange 88*b* is a portion where one end portion of the flat portion 88*a* projects. In the vicinity of the first cam 88, a sector spring 95 is provided to press and is brought into contact with the flange 88*b* of the first cam 88, in a state shown in FIG. 7. When the solenoid switch 82 performs a turn-on operation so that the locking by the solenoid lever 83 is released, the sector spring 95 forcibly presses the first cam 88 in the clockwise direction in FIG. 7 to rotate the sector gear 84 to the position where the first teeth-chipped gear 86 and the input gear 81 are engaged with each other.

(c) Second Teeth-Chipped Gear

The second teeth-chipped gear 90 is disposed on the left side (the right and upper side in FIG. 2, and the far side in FIG. 7) of the first teeth-chipped gear 89. In addition, the second teeth-chipped gear 90, of which about a third of the entire circumference is continuously chipped, is engaged with the separation roller gear 73 so as to rotationally drive the separation roller 10. Moreover, in a state of FIG. 7, the separation roller gear 73 and the like are not engaged with each other, so that the separation roller can be circulated to no useful purpose. Specifically, the above-described roller driving operation cannot be performed.

(d) Second Cam

In addition, the second cam 91 is disposed on the left side of the second teeth-chipped gear 90. In the second teeth-chipped gear 90, about a fourth of the entire circumference is continuously formed with a concave portion 91*a*. In the vicinity of the second cam 91, the separation lever 86 is provided so that the substantially central position thereof is rotatably supported. The front end portion of the separation lever 86 is brought into contact with the end portion 79*c* of the arm member 79 for changing a biasing force by the spring member 78. In the meantime, the rear end portion of the separation lever 86 is brought into contact with the outer circumferential surface of the second cam 91. With such a structure, when the rear end portion of the separation lever 86 is moved from the concave portion 91*a* onto a flange 91*b* of the second cam 91, the separation lever 86 is tilted so that the rear end portion thereof is moved down. Then, the spring member 78 is compressively deformed so that the pressure between the separation roller 10 and the separation pad 11 is strengthened. Specifically, the above-described pressure reducing operation can be performed.

(e) Third Cam

The third cam 92 is disposed on the left side of the second cam 91. The third cam 92 as a whole is formed to project into one side. In the vicinity of the third cam 92, an approximately L-shaped lift lever 85 is provided, of which the central position 85*a* is rotatably supported. In a state where the base end portion of the lift lever 85 is brought into contact with a projecting end 92*a* of the third cam 92, the stacking end of the lift lever 85 pushes down the end portion 77*c* of the arm member 77 for moving the paper feed roller 12 up and down. Specifically, at this time, the paper feed roller 12 is positioned in the initial position. On the contrary, when the third cam 92 is rotated so that the projecting end 92*a* is separated from the inside of the lift lever 85, the locking by the lift lever 85 is released, and the paper feed roller 12 moves to the paper feed position due to its own weight. Specifically, the above-described paper feed roller switching operation can be performed. Moreover, as shown in FIG. 7, the input gear 81 is connected to a driving gear 93, by which the counter roller 13 is rotationally driven, through a speed-changing gear 94.

(f) Stacking Portion Lifting Mechanism

Figure 10:
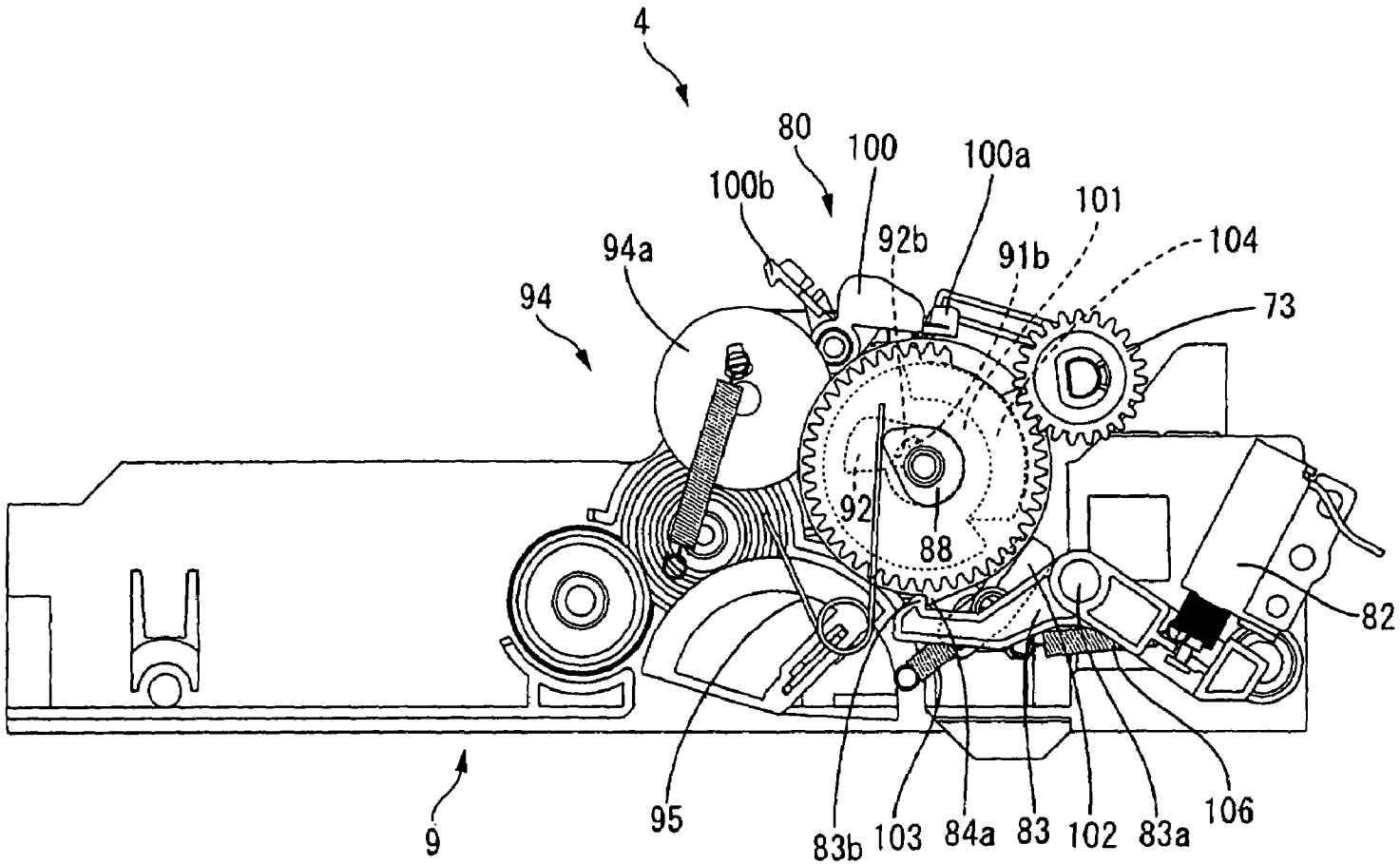
FIG. 10 is a right side view showing the gear mechanism and a paper feed cassette.

FIG. 10 is a right side view showing the gear mechanism 80 and the paper feed cassette 9. In the drawing, the right-hand side indicates the front end of the laser printer 1, and the left-hand side indicates the r ear end of the laser printer 1.

As shown in FIGS. 2 and 10, in the rear side of the end portion 77*c* of the arm member 77, a switch tilting member 100 is provided to turn on and off the driving of paper-urging-plate lifting operation. In the switch tilting member 100, the central portion is pivotally supported by a rotating shaft, which is parallel to the rotating shaft 87 of the sector gear 84, so as to be tilted. A front end portion 100*a* is positioned in the upper side of the end portion 77*c* of the arm member 77 and, in the leading end of a rear end portion 100*b*, an engagement claw is integrally provided.

Further, the end portion 77*c* of the arm member 77 is pushed down by the lift lever 85. In a state where the paper feed roller 12 is placed in the initial position, the front end portion 100*a* of the switch tilting member 100 is moved downward and the rear end portion 100*b* thereof is moved upward by a biasing unit which is not shown (a state shown in FIG. 2). In the meantime, when the pushing by the lift lever 85 is released so that the end portion 77*c* of the arm member 77 is moved upward and the paper feed roller 12 is placed at the paper feed position, the front end portion 100*a* of the switch tilting member 100 is then moved upward and the rear end portion 100*b* thereof is moved downward. At this time, the engagement claw of the rear end portion 100*b* can be engaged with a drive switch gear 94*a* of control gears 94 rotating the lever 17, so that the driving force from the input gear 81 is transmitted to the control gears 94 to lift the paper urging plate 15. Specifically, the paper-urging-plate lifting operation can be performed.

6. Basic Operation of Present Embodiment

FIGS. 11 to 14 are left cross-sectional views showing the feeder portion. In the drawings, the left-hand side indicates the front end of the laser printer 1, and the right-hand side indicates the rear end of the laser printer 1.

(1) Home Position

Here, 'the home position' corresponds to 'the initial state', which is referred to as the wait state where the gear mechanism 80 stably performs a paper feeding operation and then waits for an initiation signal of the next image forming operation. On the contrary, a state of the gear mechanism 80 in the middle of the paper feeding operation corresponds to 'the state other than the initial state'.

Figure 11:
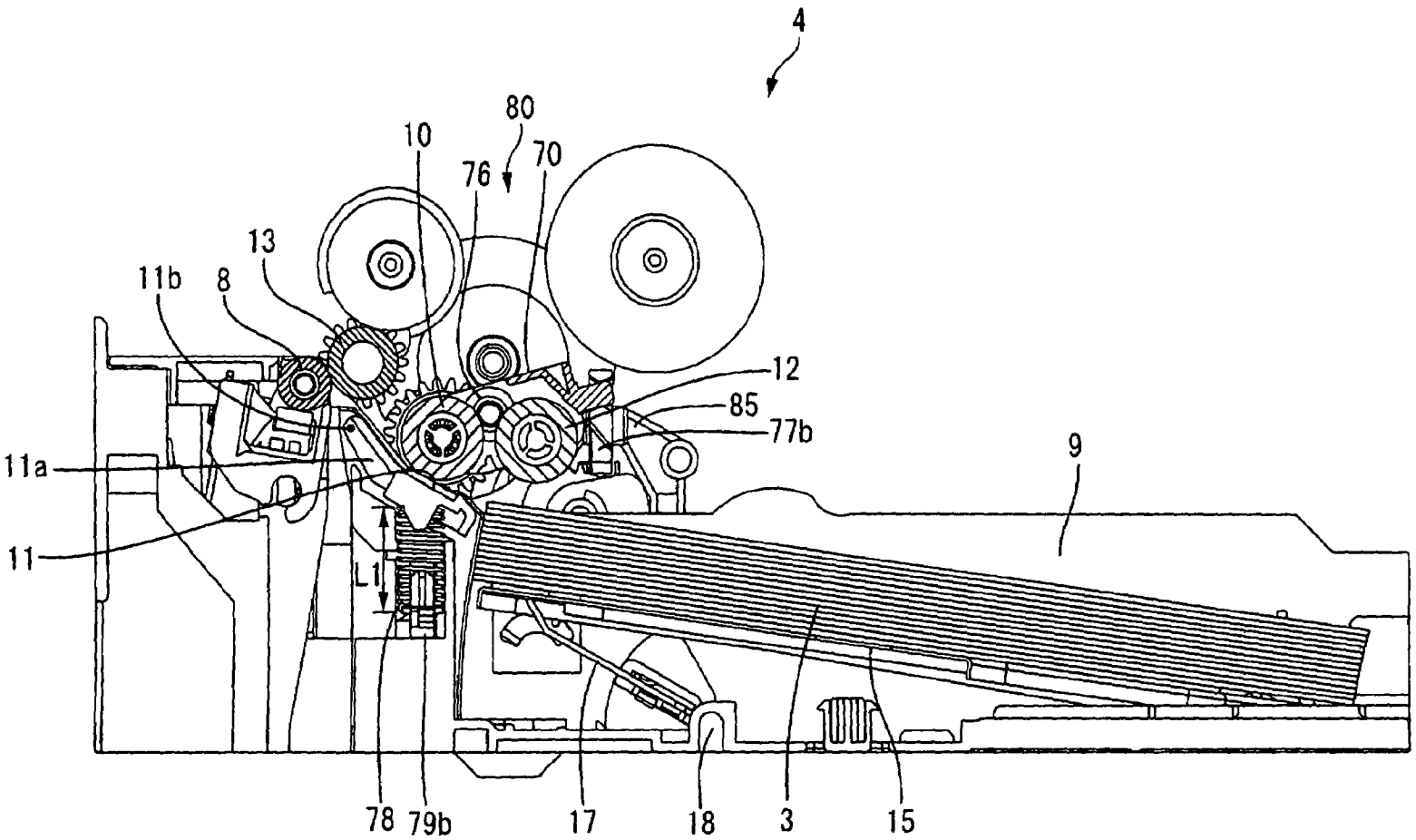
FIG. 11 is a left cross-sectional view showing the feeder portion (home position)

When the power is supplied to the laser printer 1, a driving motor is driven, and the driving force is transmitted to the input gear 81. In accordance with that, the counter roller 13 is rotationally driven through the speed-changing gear 94 and the driving gear 93. At this time, the gear mechanism 80 becomes in a state shown in FIG. 7. Specifically, the sector gear 84 is locked by the solenoid lever 83 so that the driving force from the input gear 81 is not transmitted. In addition, the lift lever 85 is locked in a state to be brought into with the projecting end 92*a* of the third cam 92 so that the end portion 77*c* of the arm member 77 is pushed down. Specifically, as shown in FIG. 11, the paper feed roller 12 is placed in the initial position to be separated from a pile of papers stacked on the paper urging plate 15 (also refer to FIG. 3).

At this time, in the switch tilting member 100, the engagement claw of the rear end portion 100*b* is regulated from being engaged with the drive switching gear 94*a* of the control gears 94, and the driving of paper-urging-plate lifting operation is stopped.

In addition, as shown in FIG. 7, the separation lever 86 is brought into contact with the concave portion 91*a* of the second cam 91 and allows the end portion 79*c* of the arm member 79 to move upward. Specifically, the end portion 79*b* of the arm member 79 is inclined downward, and the spring member 78 is compressively deformed by the length according to the separation distance (distance L1 shown in FIG. 11) between the end portion 79*b* and the arrangement plate 11*a*, which is referred to as the low-pressure state (also refer to FIG. 5).

(2) At the Time of Initiating Paper Feed Operation (Delivery Operation)

When an image forming operation is initiated and an initiation signal of the image forming operation for a first sheet of paper 3 is sent to the solenoid switch 82, the solenoid switch 82 performs a turn-on operation. Then, as shown in FIG. 8, the locking by the solenoid lever 83 is released, and the sector gear 84 is rotated by the biasing force of the sector spring 95 to the position where the first teeth-chipped gear 86 and the input gear 81 are engaged with each other. Accordingly, the rotational drive of the sector gear 84 (that is, the transmission of driving force from the input gear 84 to the sector gear 84) is initiated.

Figure 12:
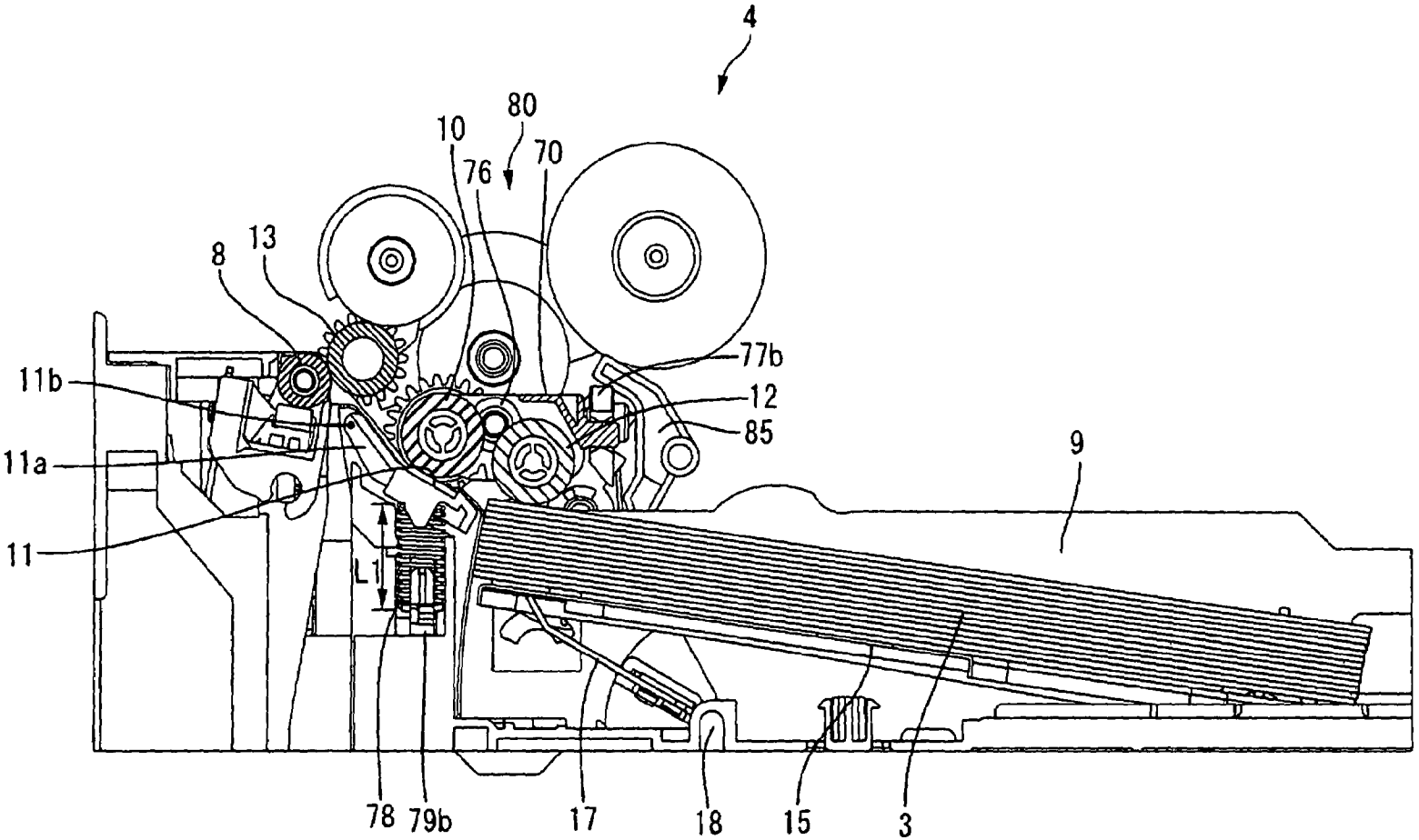
FIG. 12 is a left cross-sectional view showing the feeder portion (a state where the paper feed roller is moved downward)

Furthermore, the locking of the lift lever 85 is released by the rotation of the third cam 92, and the end portion 77*c* of the arm member 77 is allowed to move upward. Accordingly, as shown in FIG. 12, the paper feed roller 12 is moved down to the paper feed position to be brought into contact with a pile of papers stacked on the paper urging plate 15 (also refer to FIG. 4).

At this time, the switch tilting member 100 performs the paper-urging-plate lifting operation so that the locking claw of the rear end portion 100*b* thereof can be engaged with the drive switching gear 94*b* of the control gears 94. That is, when the paper feed roller 12 placed at the paper feed position is placed at the lower position than a predetermined height where the paper 3 can be fed, the engagement claw of the rear end portion 100*b* is engaged with the drive switching gear 94*a* of the control gears 94 and the driving force from the input gear 81 is transmitted to the control gears 94, so that the paper urging plate 15 is lifted. Further, when the paper feed roller 12 reaches the predetermined height, the engagement between the engagement claw of the rear end portion 100*b* and the drive switching gear 94*a* is released and the driving force from the input gear 81 is not transmitted to the control gears 94, so that the paper urging plate 15 is stopped at the height.

Figure 13:
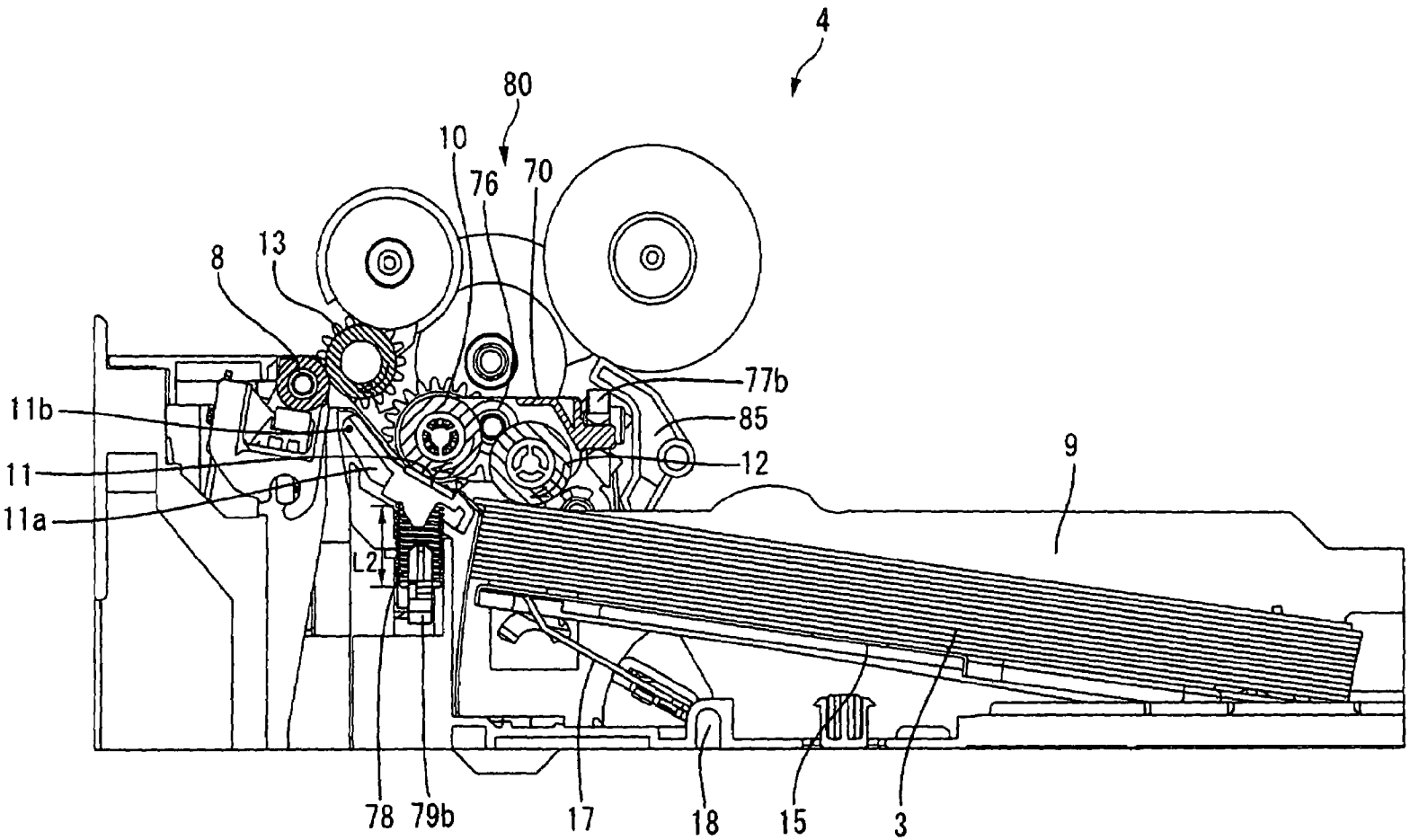
FIG. 13 is a left cross-sectional view showing the feeder portion (a high-pressure state)

In addition, by the rotation of the second cam 91, the rear end portion of the separation lever 86 gets on the flange 91*b*, so that the end portion 79*c* of the arm member 79 is pushed down. Accordingly, as shown in FIG. 13, the end portion 79*b* of the arm member 79 is tilted upward, and the spring member 78 is further compressively deformed (length L2 (<L1) shown in FIG. 13), so that the separation pad 11 and the separation roller 10 become in the high-pressure state (also refer to FIG. 6).

After that, as shown in FIG. 8, the second teeth-chipped gear 90 and the separation roller gear 73 are engaged with each other, and the rotational drive of the separation roller 10 (specifically, the transmission of driving force from the input gear 81 to the separation roller 10) is initiated. Further, the paper feed roller 12 is also rotationally-driven dependently, so that the paper feeding operation of paper 3 is initiated.

As described above, a pile of papers is brought into contact with the paper feed roller 12 to be delivered to the downstream side of the conveying direction. A sheet of paper 3 placed on the uppermost layer is reliably separated in the separation position X between the separation pad 11 and the separation roller 10 which are pressed against each other by a relatively strong biasing force according to the length L2.

(3) Lifting Paper Feed Roller and Reducing Pressure of Separation Pad

Figure 14:
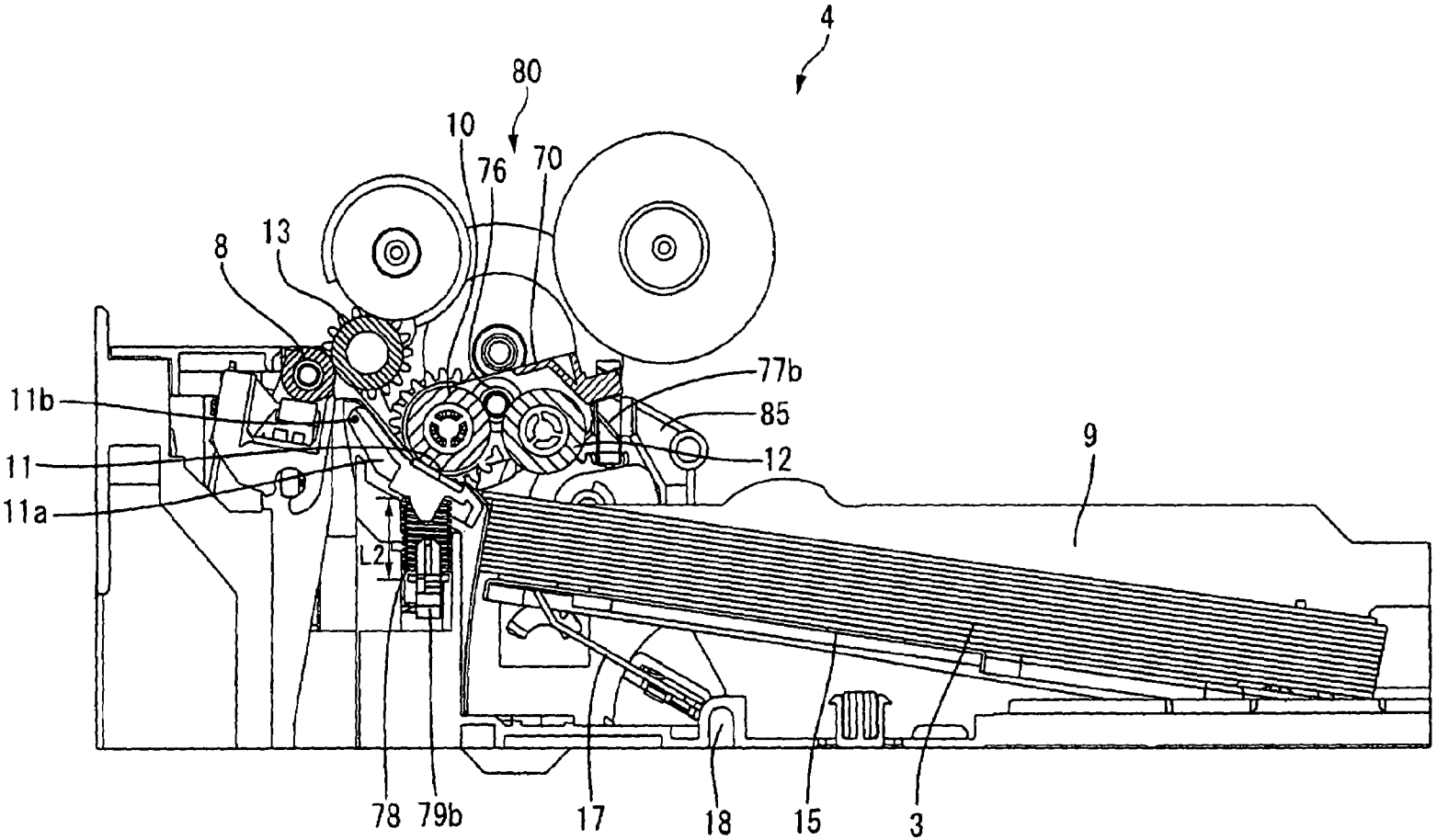
FIG. 14 is a left cross-sectional view showing the feeder portion (a state where the paper feed roller is moved upward)

Subsequently, when the leading end of the paper 3 separated by the separation pad 11 and the separation roller 10 reaches the nip position between the paper powder removing roller 8 and the counter roller 13 (corresponding to 'while a sheet passes between the separation unit and the supply roller'), the projecting end 92*a* of the third cam 92 starts to be brought into contact with a tapered surface 85 provided in the leading end side of the base end portion of the lift lever 85, as shown in FIG. 9. Further, as the projecting end 92*a* is guided by the tapered surface 85*b*, it is gradually guided to the position where the lift lever 85 again pushes down the end portion 77*c* of the arm member 77. Therefore, as shown in FIG. 14, the paper feed roller 12 is moved to the initial position to be separated from a pile of papers stacked on the paper urging plate 15 (moving the paper feed roller up and down).

Next, the rear end portion of the separation lever 86 is placed into the concave portion 91*a* from the flange 91*b* of the second cam 91. Accordingly, the end portion 79*c* of the arm member 79 is allowed to move upward. As shown in FIG. 11, the length of the spring member 78 returns to the length L1, and the separation pad 11 and the separation roller 10 are pressed by a weaker biasing force than that at the time of initiating the paper feeding operation (the pressure reducing operation).

Here, since the paper feed roller 12 has been already placed at the initial position, there is no conveying resistance caused by the contact with the paper feed roller 12. Accordingly, even though the pressure between the separation pad 11 and the separation roller 10 is reduced, sufficient separation ability can be exhibited. At this time, there is no conveying resistance caused by the paper feed roller 12, and the conveying resistance caused by the separation pad 11 and the separation roller 10 are reduced. Therefore, the conveying of paper 3 can be performed smoothly by the paper powder removing roller 8, the counter roller 13, and the resist rollers 14.

After that, when the teeth-chipped portion of the first teeth-chipped gear 89 is opposite to the input gear 81, the sector gear 84 is locked again by the solenoid 83 and returns to the home position state. Therefore, the separation roller 10 can be circulated to no useful purpose.

Afterwards, the gear mechanism 80 repeatedly performs a series of the above-described operations, whenever the initiation signal of the image forming operation for each of the following papers 3 is sent to the solenoid switch 82.

7. Paper-Feed-Roller Forcibly-Displacing Unit

Figure 15:
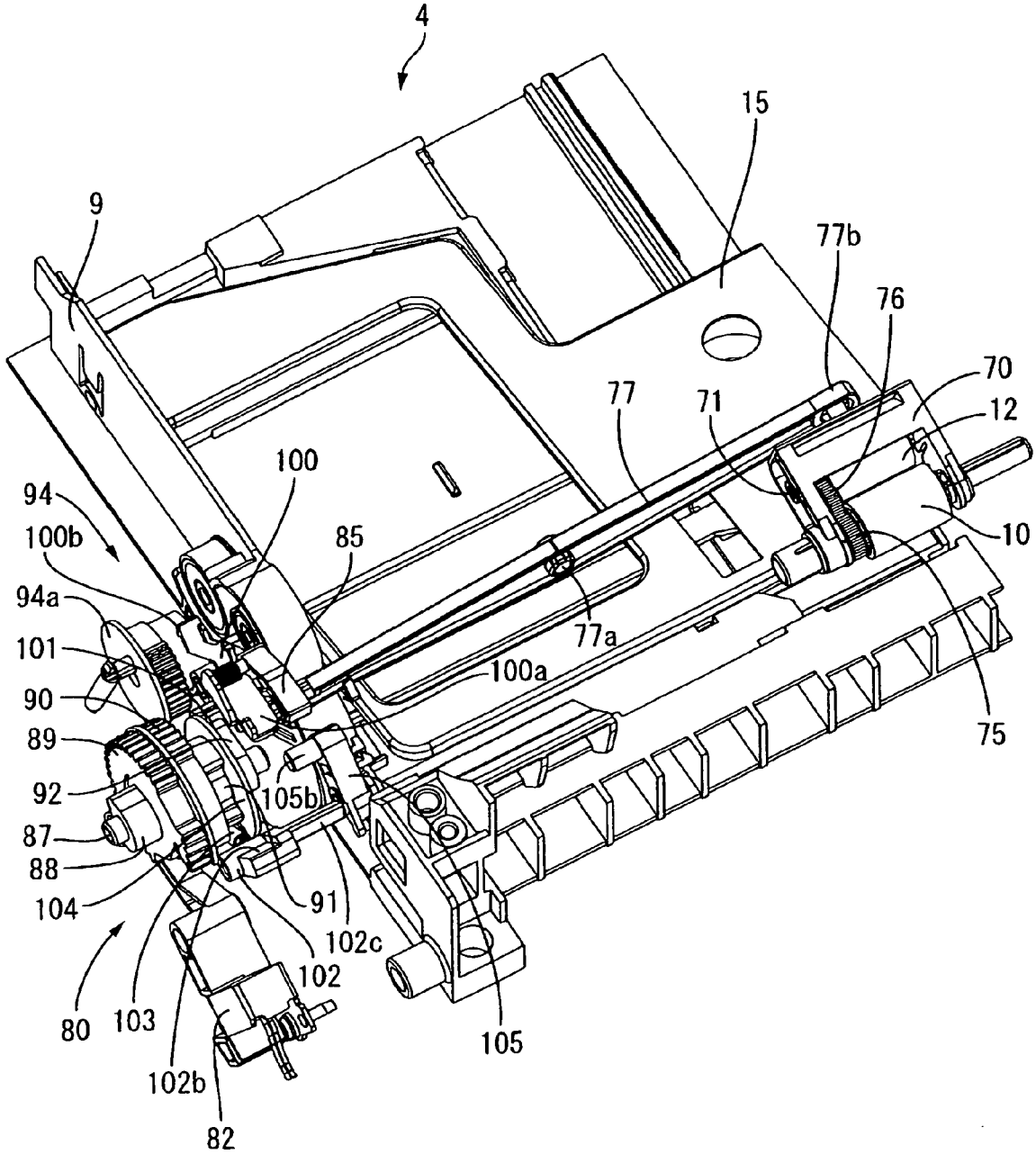
FIG. 15 is a perspective view of the gear mechanism and the paper feed cassette which partially shows the construction corresponding to a paper-feed-roller forcibly-displacing unit.
Figure 16:
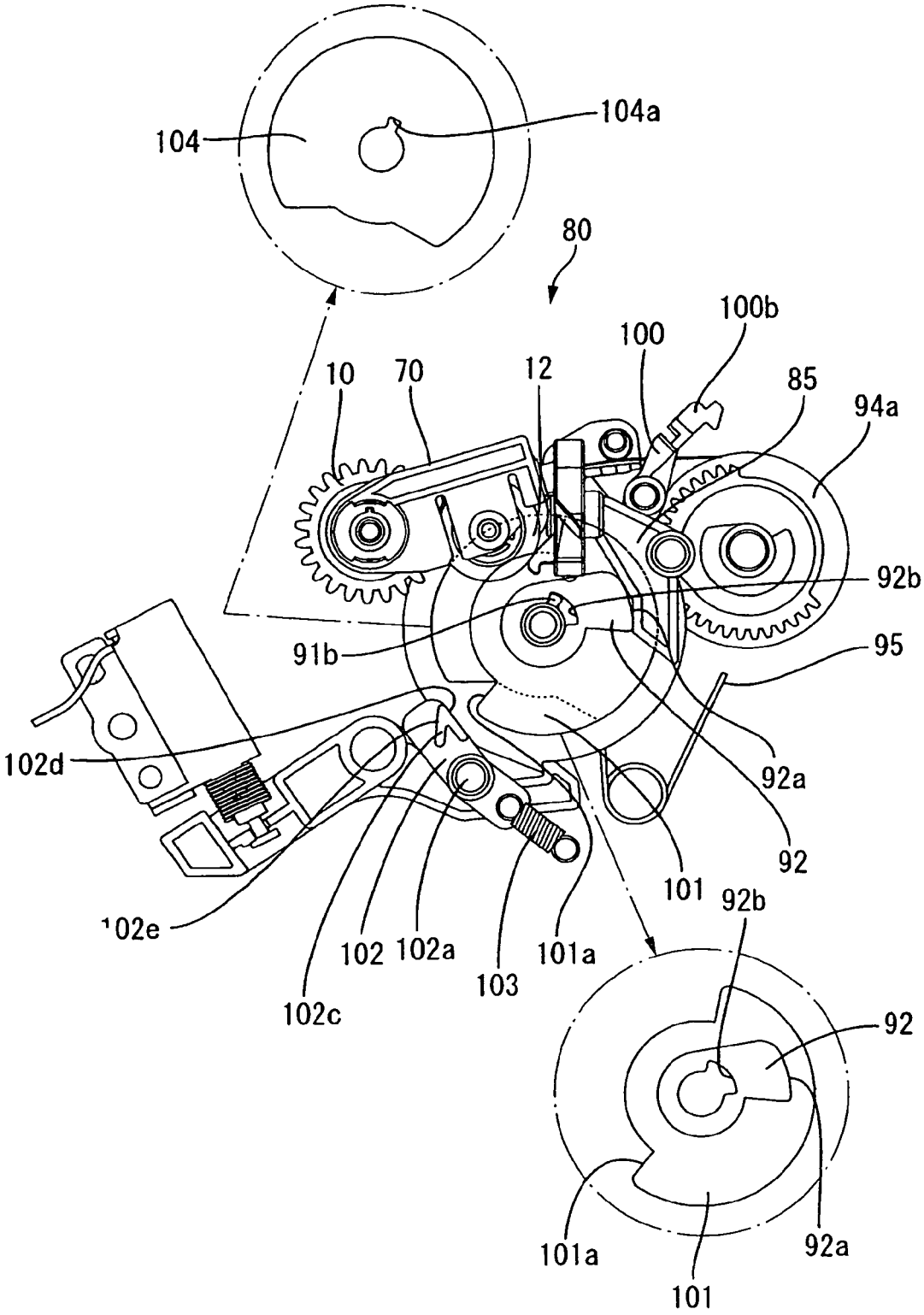
FIG. 16 is a left side view showing the gear mechanism section of a device main body.
Figure 17:
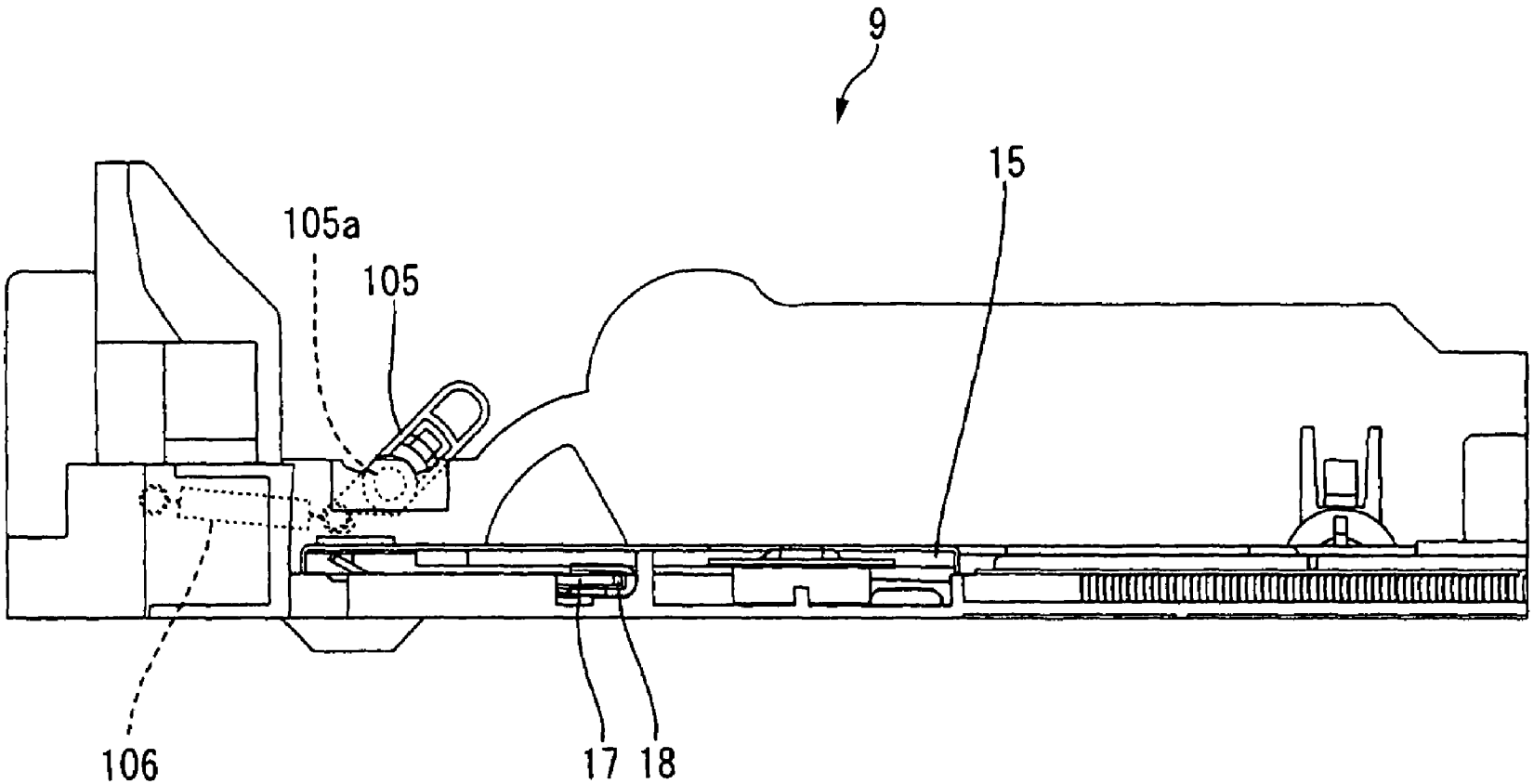
FIG. 17 is a left side view showing the paper feed cassette in a state of being pulled out of the device main body.

FIG. 15 is a perspective view of the gear mechanism 80 and the paper feed cassette 9 (the right lower side in the drawing indicates the front end of the laser printer 1), partially illustrating the structure corresponding to a paper-feed-roller forcibly-displacing unit. FIG. 16 is a partially expanded diagram illustrating the gear mechanism 80 of the device main body 4*a* (the left side in the drawing indicates the front end of the laser printer 1). FIG. 17 is a partial side view showing the paper cassette 9 in a state of being pulled out of the device main body 4*a*. (the left side in the drawing indicates the front side of the laser printer 1). Moreover, FIG. 16 shows a state where the gear mechanism 80 is placed in the home position and the paper feed roller 12 is placed in the initial position.

(1) Construction of Gear Mechanism (Device Main Body)

As shown in FIG. 16, the third cam 92 is incorporated by a disc member 101 of which about a half of the entire circumference is continuously concave. In addition, the second cam 91, which is integrally rotated with the sector gear 84, is provided with a projection 91*b*. On the other hand, the third cam 92 is formed with an arc-shaped opening portion 92*b* into which the projection 92*b* can be inserted and which has an alley (clearance) in the rotation direction of the third cam 92.

Further, when the gear mechanism 80 is placed at the home position, one end surface (which corresponds 'a pressed portion' and is hereinafter referred to as the pressed portion 101*a*)

of the flange portion of the disc member 101 is directed to the front side of the laser printer 1 in the lower position, and the projection 91*b* is brought into contact with the end portion within the arc-shaped opening 92*b* in the counter clockwise direction of the drawing. Specifically, before the second cam 91 or the like rotates, the third cam 92 can rotate in the rotational direction (the counter clockwise direction in the drawing) of the second cam 91 or the like when the gear mechanism 80 is driven by the applied driving force.

In addition, in the side of the device main body 4*a*, a contacting member 102, by which a substantially central portion 102*a* is pivotally supported, is provided to be swingable between the contact position to be brought into contact from the front side to the rear side on the pressed portion 101*a* placed in the lower position at the time of the home position, and the retract position (refer to FIG. 16) to be retracted in the front side of the gear mechanism 80. The contacting member 102, of which the lower position is connected to a first spring member 103, is always biased to the retract position.

In addition, as shown in FIG. 15, on the upper end portion of the contacting member 102, a pressing portion 102*b* is formed to press the pressed portion 101*a* of the disc member 101 from the front side. In addition, on the upper end portion of the contacting member 102, an extending portion 102*c* which extends to the side of the paper feed cassette 9 is integrally provided. The extending portion 102*c* has a first surface 102*d* along the longitudinal direction of the contacting member 102 and a second surface 102*e* of which the leading end is connected to the leading end of the first surface 102*d* and which is inclined with respect to the first surface 102*d*.

Further, between the second cam 91 and the third cam 92, a stopper member 104 is provided, which corresponds to 'the stopper member or regulating unit'. As shown in FIG. 16, the stopper member 104 is formed in a disc shape, of which a fifth of the entire circumference is continuously concave. In addition, the stopper member 104, having an engaged portion 104*a* which is engaged with the projection 91*b* of the second cam 91 without any clearance, is integrally rotated with the second cam 91. Moreover, the concave portion of the stopper member 104 is directed to the lower side at the time of the home position so that the stopper member 104 is not interfered with the moving path of the contacting member 102 from the retract position to the contact position.

(2) Construction of Paper Feed Cassette

In the side of the paper feed cassette 9, a pressing portion 105, by which a substantially central portion 105*b* is pivotally supported, is provided to be swingable between the pressing position (a state shown in FIG. 17), where the upper end portion thereof is inclined to the rear end side of the paper feed cassette 9, and the contact position where the upper end portion is inclined to the front end side of the paper feed cassette 9, as shown in FIG. 17. The pressing member 105, of which the lower end portion is connected to a second spring member 106, is always biased to the pressing position. The second spring member 106 has a stronger biasing force than that of the first spring member 103.

In addition, as shown in FIG. 15, on the upper end portion of the pressing member 105, a pressing portion 105*b* extends, which presses the extending portion 102*c* of the contacting member 102 from the front side to the rear side (the far side of the insertion direction of the paper feed cassette 9), when the paper feed cassette 9 is housed in the device main body 4*a*.

Figure 18:
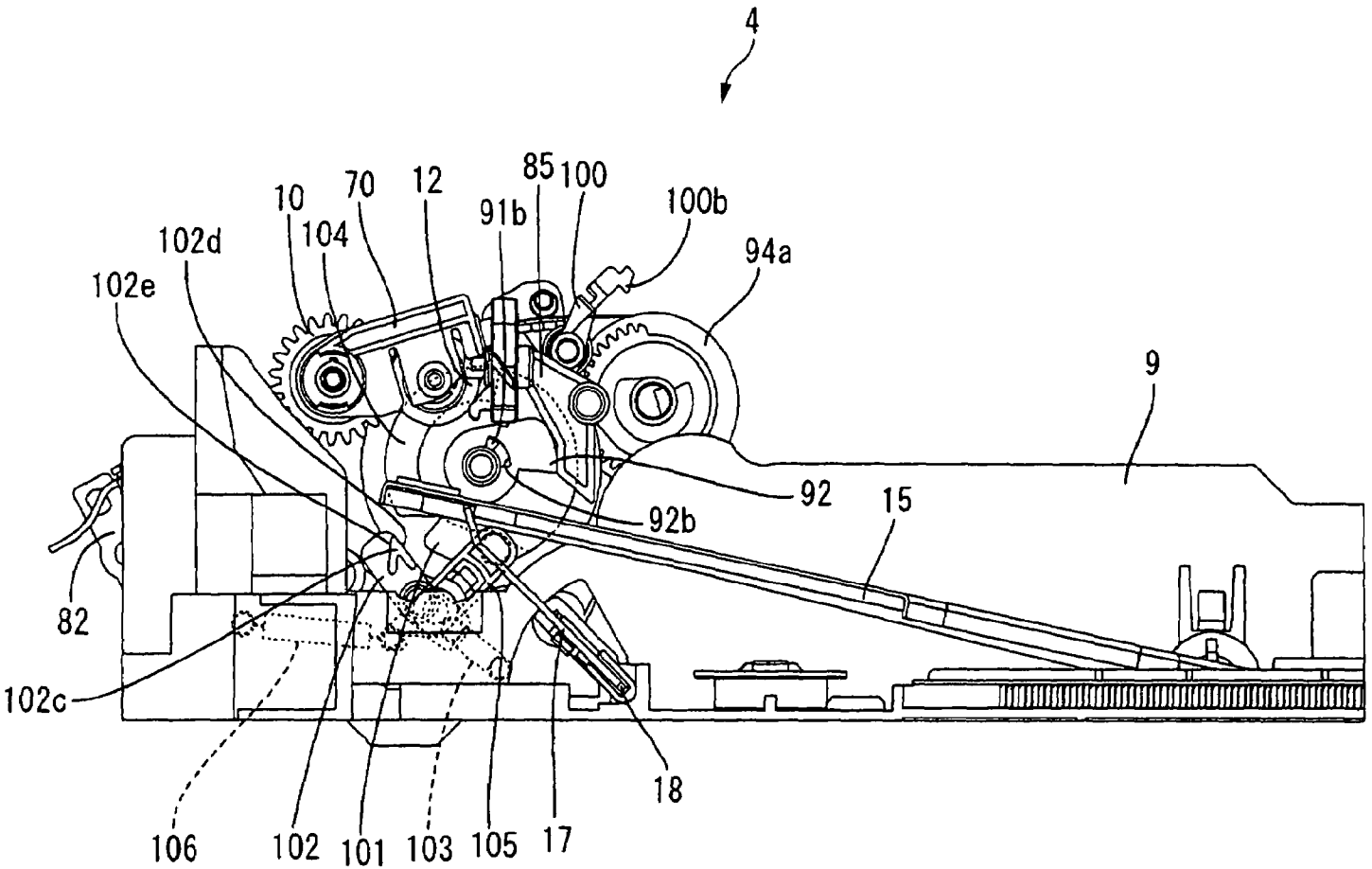
FIG. 18 is a left cross-sectional view showing the feeder portion at the time of the home position.
Figure 19:
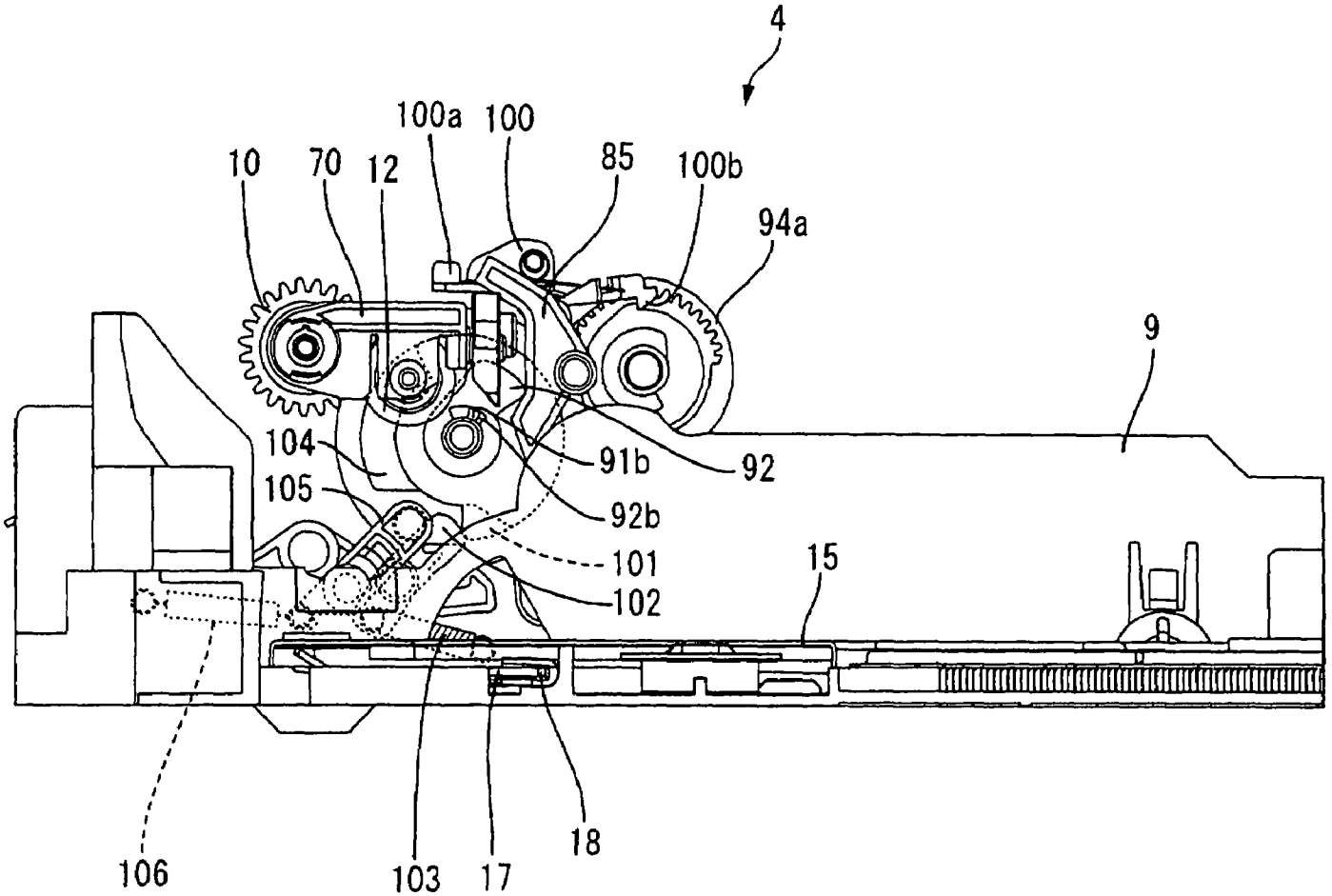
FIG. 19 is a left cross-sectional view showing the feeder portion at the time of the paper-feed-roller forcibly-displacing operation.

8. Operational Effect of Paper-Feed-Roller Forcibly-Displacing Operation (1) At the time of Replenishing Papers FIGS. 18 and 19 are left cross-sectional views showing the feeder portion at the time of the home position and the paper-feed-roller forcibly-displacing operation. In the drawings, the left side indicates the front side of the laser printer 1, and the right side indicates the rear side of the laser printer 1.

When the gear mechanism 80 stably returns to the home position after receiving an initiation signal of image forming operation to perform the paper feeding operation of paper 3, the gear mechanism 80 and the paper feed cassette 9 become in a state shown in FIG. 18. In this state, if the paper feed cassette 9 is pulled out of the device main body 4*a* to replenish papers, the gear mechanism 80 is maintained in a state of the home position as shown in FIG. 16. In the meantime, if the connection between the paper feed cassette 9 and the gear mechanism 80 is released, the front end portion of the paper urging plate 15 moves downward due to its own weight so that the paper urging plate 15 is placed at the stacking position, as shown in FIG. 17.

After the papers 3 are replenished, the paper feed cassette 9 is mounted again on the device main body 4*a*. In this process, the pressing portion 105*b* (refer to FIG. 15) of the pressing member 105 in the side of the paper feed cassette 9 is brought into contact with the second surface 102*e* of the extending portion 102*c* of the contacting member 102 in the side of the device main body 4*a*. Here, the biasing force of the first spring member 103 is stronger than that of the second spring member 106. Accordingly, if the paper feed cassette 9 is pushed into the device main body 4*a*, the contacting member 102 is pressed by the pressing member 105 to be displaced from the retract position to the contact position, as shown in FIG. 19.

At this time, the pressing portion 102*b* (refer to FIG. 15) of the contacting member 102 presses the pressed potion 101*a* of the disc member 101 so that the third cam 92 itself is rotated in the counter clockwise direction in the drawing. Accordingly, the locking of lift lever 85 by the third cam 92 is released, and the end portion 77*c* of the arm member 77 is allowed to move upward. Moreover, when the paper feed cassette 9 is further pushed inside to be housed in the regular housing position, the pressing portion 105*b* (refer to FIG. 15) of the pressing member 105 overleaps the second surface 102*e* of the extending portion 102*c* of the contacting member 102. As shown in FIG. 18, the pressing member 105 is placed in the pressing position, and the contacting member 102 returns to the retract position.

Accordingly, as shown in FIG. 12, the paper feed roller 12 is moved down to the paper feed position where the paper feed roller 12 is brought into contact with a pile of papers stacked on the paper urging plate 15 (also refer to FIG. 4). Therefore, the paper-pressing-plate lifting operation can be controlled, and the paper urging plate 15 placed at the stacking position is lifted to the position where the paper feed roller 12 is placed at a predetermined height. Specifically, before an initiation signal of the next image forming operation is received, the paper urging plate 15 can be previously disposed to the paper feed position where the paper can be fed. Accordingly, even when an initial paper feeding operation is performed after the paper feed cassette 9 is mounted again, the paper 3 can be stably fed.

(2) At the time of Abnormality during Paper Feeding Operation

Figure 20:
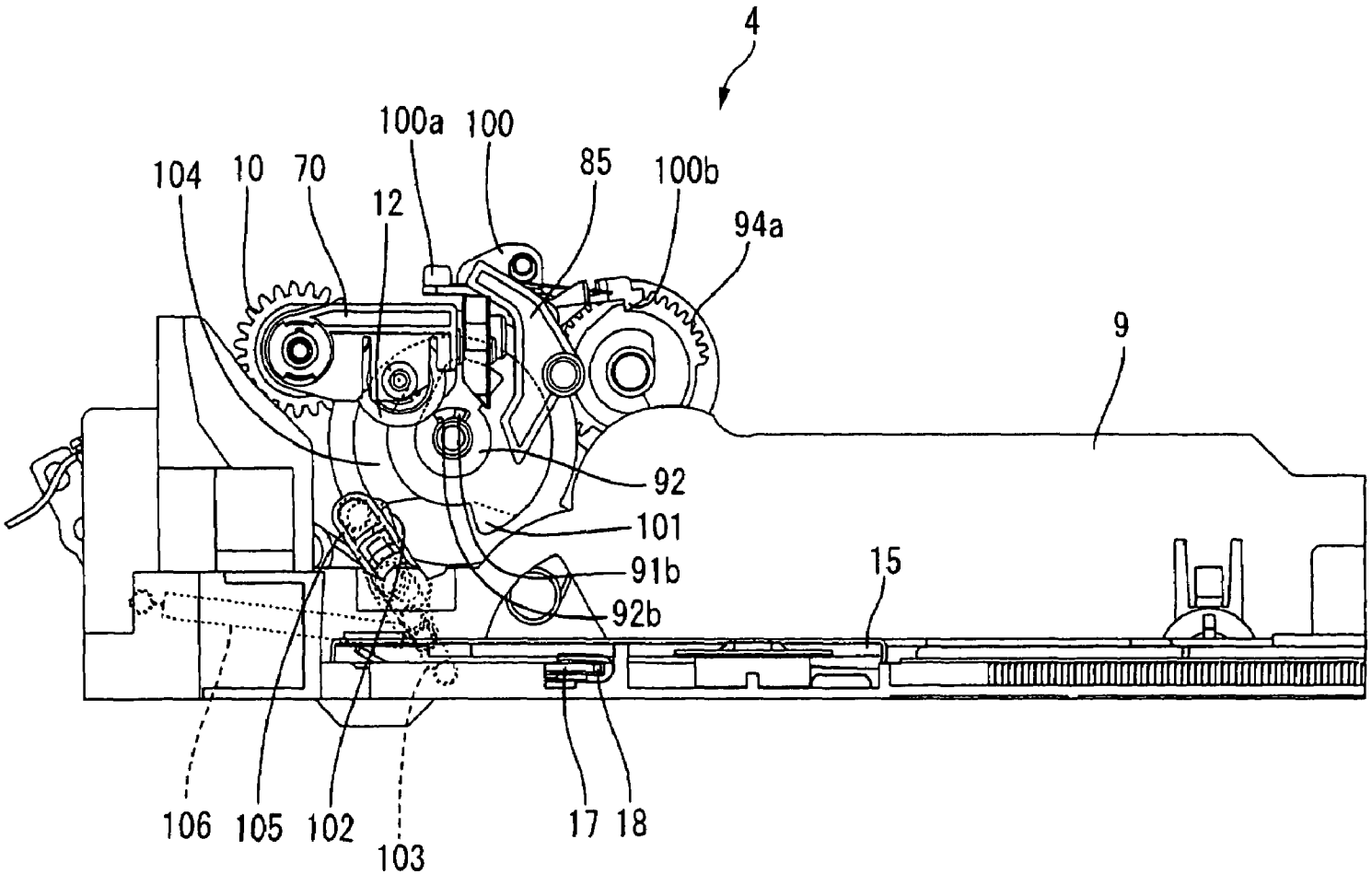
FIG. 20 is a left cross-sectional view showing the feeder portion at the time of regulating the paper-feed-roller forcibly-displacing operation.

FIG. 20 is a right cross-sectional view showing the feeder portion when the paper-feed-roller forcibly-displacing operation is regulated. In the drawing, the left-hand side indicates the front side of the laser printer 1, and the right-hand side indicates the rear side of the laser printer 1.

For example, when abnormalities such as paper jam occur in the paper feeding operation, the gear mechanism 80 is stopped at the moment. At this time, the paper feed roller 12 is placed at the paper feed position. In this state, if the paper feed cassette 9 is pulled out of the device main body 4*a*, the paper urging plate 15 is placed at the stacking position as expected. Further, after the jammed paper 3 is removed, the paper feed cassette 9 is mounted again on the device main body 4*a*. In this process, the pressing portion 105*b* of the pressing member 105 is brought into contact from the front side on the second surface 102*e* of the extending portion 102*c* of the contacting member 102. As shown in FIG. 20, however, the pressing portion 102*b* of the contacting member 102 is brought into contact with the flange portion of the stopper member 104 so that the movement to the contact position is regulated. Accordingly, the pressing member 105 is also displaced to the contact position against the biasing force of the second spring member 106. In this state, the paper feed cassette 9 is disposed at the regular housing position.

If so, the gear mechanism 80 starts to be driven. At this time, as shown in FIG. 20, since the locking of the lift lever 85 by the third cam 92 is released, the paper feed roller 12 is placed at the paper feed position and the paper-pressing-plate lifting operation is performed so that the paper urging plate 15 placed at the stacking position starts to be lifted. Further, when the gear mechanism 80 is rotated so that the lift lever 85 is locked by the third cam 92 (a locking state), the regulation of contacting member 102 by the stopper member 14 is released. Accordingly, the pressing member 105 moves the contacting member 102 to the contact position by use of the resilience of the second spring member 106 and presses the pressed portion 101*a* of the disc member 101 so as to rotate the third cam 92 in the counter clockwise direction in the drawing (refer to FIG. 19). Accordingly, the locking of the lift lever 85 by the third cam 82 is released, and the paper-pressing-plate lifting operation is continued or restarted. Therefore, even in this case, before an initiation signal of the next image forming operation is received, the paper urging plate 15 can be previously disposed in the paper feed position. Even when an initial paper feeding operation is performed after the paper feed cassette 9 is mounted again, the paper 3 can be stably fed.

According to the embodiment, the delivery roller switching unit is dynamically controlled by the mechanical construction. Herewith, malfunction such as soft control can be prevented. Furthermore, since the control is performed by the driving force from the gear mechanism which rotates and controls the delivery roller or the separation roller, the timing of switching the delivery roller by the switching unit can be easily set based on the rotation position of the delivery roller or the separation roller. Moreover, it is preferable that the cam be rotated on the same shaft as the gear of the gear mechanism.

Also, when the supply operation of sheets is finished and the storage cassette is pulled out of the device main body, the delivery roller is disposed at the initial position by the cam. Further, when the storage cassette is mounted, the cam is rotated through the alley (clearance) by the cam rotating unit, so that the delivery roller is moved to the delivery position. Accordingly, the delivery-roller forcibly-displacing unit can be implemented by a relatively simple construction.

Further, when the supply operation of sheets is finished and the storage cassette is pulled out of the device main body, the delivery roller is disposed at the initial position by the cam. Further, when the storage cassette is mounted again, the pressed portion is rotated through the clearance by the pressing portion in the side of the storage cassette, so that the delivery roller is moved to the delivery position. Accordingly, the delivery-roller forcibly-displacing unit can be implemented by a relatively simple construction.

Additionally, when abnormal supply, where the sheet is jammed in the conveying path, occurs in the supply operation of sheet so that the supply operation is stopped, the storage cassette can be pulled out and mounted again. In this case, the gear mechanism is stopped in the supply operation of a sheet of sheet. At this time, in the gear mechanism, it cannot be grasped how the gear mechanism is stopped. Accordingly, when gear mechanism is driven again and becomes in the initial state waiting for a supply start signal of the next sheet, the regulation by the regulation unit is released so that the delivery roller is moved from the initial position to the delivery position by the delivery-roller forcibly-displacing unit. Herewith, even when the storage cassette is mounted again after abnormal supply, the supply operation can be smoothly resumed.

Also, when the storage cassette is mounted again because of abnormal supply and when the gear mechanism is not in the initial state, the stopper member serving as the regulation unit is interfered with the contacting member against the pressing force of the pressing portion, and the delivery roller is regulated from being displaced to the delivery position. Further, when the gear mechanism becomes in the initial state, the regulation by the stopper member is released, and the contacting member is brought into contact with the pressed portion by the pressing force of the pressing portion so as to rotate the cam so that the delivery roller is displaced to the delivery position.

According to such a construction, if a user simply mounts the storage cassette on the device main body, the supply operation can be stably restarted, even when the sheet is replenished and abnormal supply occurs.

Furthermore, the regulation unit is dynamically controlled by the mechanical construction. Therefore, malfunction such as soft control can be prevented. Furthermore, since the control is performed by the driving force from the gear mechanism which rotates and controls the delivery roller, the regulation timing by the regulating unit can be easily set based on the rotation position of the delivery roller.

Other Embodiments

The invention is not limited to the embodiment which has been described by the above descriptions and the drawings. For example, the following embodiments are included in the technical scope of the invention. Further, various changes other than the followings may be made therein without departing from the spirit and scope of the invention.

(1) When the paper feed cassette 9 can be pulled out of the device main body 4*a*, it may or may not be attached and removed.

(2) The above embodiment may be constructed so that only the problem when the paper feed cassette 9 is mounted at the time of replenishing papers is solved, without the stopper member 104 being provided.

(3) For regulation, the stopper member 104 may be constructed so as to be interfered with the pressing member 105, not with the contacting member 102.

(4) Without the second spring member 106, the pressing member 105 may be constructed so as to be manually moved between the pressing position and the contact position.

(5) The first and second biasing unit may not be formed of a spring member but be formed of other elastic members such as rubber member and the like.

(6) The above embodiment may be constructed without the contacting member 102. Specifically, it may be constructed so that the disc member 101 is directly pressed to be rotated by the pressing member 105.

What is claimed is:

1. A sheet supply device comprising:

a device main body;

a storage cassette that has a stacking portion capable of moving up and down, on which sheets are stacked, the storage cassette being configured to be pulled out of the device main body;

a delivery roller that is provided to be movable up and down and is rotated in a state where the delivery roller is brought into contact with a sheet stacked on the stacking portion, so as to deliver the sheet to a downstream side of a conveying direction thereof;

a separation roller that is provided at the downstream side of the conveying direction with respect to the delivery roller and is configured to separate the sheets delivered by the delivery roller one at a time;

a roller unit that comprises the delivery roller and the separation roller;

a gear mechanism that receives a sheet supply start signal to rotate and control the delivery roller;

a shaft that connects the delivery roller and the gear mechanism;

a cam that is interlocked with the gear mechanism and is rotated by a driving force of the gear mechanism;

a moving unit that is brought into contact with the cam and moves the delivery roller from an initial position, where the delivery roller is separated from the stacking portion, and a delivery position;

a connecting member that connects the roller unit and the moving unit, a first end portion of the connecting member contacting with the roller unit, a second end portion of the connecting member contacting with the moving unit, the moving unit moving the second end portion downwardly to displace the delivery roller to the initial position, and the moving unit moving the second end portion upwardly to displace the delivery roller to the delivery position; and a delivery-roller forcibly-displacing unit that forcibly displaces the delivery roller from the initial position to the delivery position, when the storage cassette is attached to the device main body.

2. The sheet supply device according to claim 1, wherein the second end of the connecting member contacts with the roller unit at an upstream side of the delivery roller.

3. The sheet supply device according to claim 1, wherein the connecting member comprises a fulcrum between the first end portion and the second end portion, and the connecting member is configured to rotate around the fulcrum.

4. The sheet supply device according to claim 3, wherein the moving unit moves the second end portion downwardly to displace the delivery roller upwardly, and the moving unit moves the second end portion upwardly to displace the delivery roller downwardly.

5. The sheet supply device according to claim 1, wherein the cam is provided to have a clearance with respect to a rotation of the gear mechanism in a rotation direction thereof, and the delivery-roller forcibly-displacing unit comprises a cam rotating unit that rotates the cam through the clearance in an attaching process of the storage cassette so as to move the delivery roller to the delivery position.

* * * * *